US008757039B2

(12) United States Patent
Martinez et al.

(10) Patent No.: US 8,757,039 B2
(45) Date of Patent: Jun. 24, 2014

(54) NON-LETHAL RESTRAINT DEVICE WITH DIVERSE DEPLOYABILITY APPLICATIONS

(75) Inventors: Martin A. Martinez, Phoenix, AZ (US); Patrick Barnhill, Phoenix, AZ (US); Steven A. Floyd, Petaluma, CA (US)

(73) Assignee: Engineering Science Analysis Corporation, Tempe, AZ (US)

( * ) Notice: Subject to any disclaimer, the term of this patent is extended or adjusted under 35 U.S.C. 154(b) by 0 days.

(21) Appl. No.: 12/901,130

(22) Filed: Oct. 8, 2010

(65) Prior Publication Data

US 2011/0030540 A1 Feb. 10, 2011

Related U.S. Application Data

(62) Division of application No. 12/185,947, filed on Aug. 5, 2008, now Pat. No. 7,882,775.

(60) Provisional application No. 60/963,927, filed on Aug. 7, 2007.

(51) Int. Cl.

| | |
|---|---|
| ***F41F 7/00*** | (2006.01) |
| ***B63G 9/04*** | (2006.01) |
| ***F41H 13/00*** | (2006.01) |
| ***F42B 23/10*** | (2006.01) |
| ***F42B 12/40*** | (2006.01) |
| ***F42B 23/24*** | (2006.01) |
| ***F42B 23/00*** | (2006.01) |

(52) U.S. Cl.

CPC *F41H 13/00* (2013.01); *B63G 9/04* (2013.01); *F41H 13/0006* (2013.01); *F42B 23/10* (2013.01); *F42B 12/40* (2013.01); *F42B 23/24* (2013.01); *F42B 23/00* (2013.01)

USPC ..... 89/1.34; 404/6

(58) Field of Classification Search

USPC ..... 89/1.34, 1.11; 188/8, 4 R; 102/402, 403, 102/406, 409, 502, 503, 504; 404/6

See application file for complete search history.

(56) References Cited

U.S. PATENT DOCUMENTS

| | | | | | |
|---|---|---|---|---|---|
| 1,067,080 | A | * | 7/1913 | Torday | 102/504 |
| 2,111,374 | A | * | 3/1938 | Sedgley | 42/106 |
| 2,469,533 | A | * | 5/1949 | Wellcome | 89/1.34 |
| 3,093,808 | A | * | 6/1963 | Tatnall et al. | 367/4 |
| 3,606,719 | A | * | 9/1971 | Berry | 52/632 |
| 3,865,398 | A | * | 2/1975 | Woll | 280/733 |
| 3,930,448 | A | * | 1/1976 | Barber et al. | 102/348 |
| 4,240,371 | A | * | 12/1980 | Perry | 116/210 |
| 4,253,132 | A | * | 2/1981 | Cover | 361/232 |
| 4,261,535 | A | * | 4/1981 | Swanson | 244/130 |
| 4,559,737 | A | * | 12/1985 | Washington | 43/59 |
| 5,345,874 | A | * | 9/1994 | Lemonnier et al. | 102/424 |

(Continued)

*Primary Examiner* — Reginald Tillman, Jr.

(74) *Attorney, Agent, or Firm* — Perkins Coie LLP

(57) ABSTRACT

An immobilization device and method of restraining vehicles, persons and animals uses tendrils attached to various devices to engage the target. The immobilization device, system and method includes a housing containing launchable tendrils that are launched from the housing by a propellant. The tendrils may be attached to straps or other elements carried by the immobilization device. The tendrils will engage the target and restrain it if it is a vehicle such as a car, truck, boat, submarine, or like vehicle. In stopping a person or animal the tendrils will deliver a marking package, a shocking package or a snare package to mark, shock or snare the target. Straps may be pulled off the housing leaving the housing near the point of deployment.

18 Claims, 21 Drawing Sheets

(56) References Cited

U.S. PATENT DOCUMENTS

| | | | | |
|---|---|---|---|---|
| 5,460,155 | A * | 10/1995 | Hobbs, II | 124/56 |
| 5,561,263 | A * | 10/1996 | Baillod | 102/504 |
| 5,811,713 | A | 9/1998 | Gudgel | |
| 5,839,753 | A * | 11/1998 | Yaniv et al. | 280/733 |
| 5,904,443 | A * | 5/1999 | Soleau | 404/6 |
| 5,921,704 | A | 7/1999 | Pacholok et al. | |
| 6,266,926 | B1 * | 7/2001 | Figge et al. | 52/1 |
| 6,312,188 | B1 | 11/2001 | Ousterhout et al. | |
| 6,382,071 | B1 * | 5/2002 | Bertani | 89/1.34 |
| 6,623,205 | B1 | 9/2003 | Ramirez | |
| 6,854,374 | B1 * | 2/2005 | Breazeale | 86/50 |
| 7,056,054 | B1 | 6/2006 | Keith et al. | |
| 7,162,958 | B2 * | 1/2007 | Shilliday et al. | 102/530 |
| 7,201,531 | B2 | 4/2007 | Shackelford et al. | |
| 7,210,875 | B1 * | 5/2007 | Christle et al. | 404/6 |
| 7,220,076 | B2 | 5/2007 | Boll | |
| 7,226,238 | B2 * | 6/2007 | Collier | 404/6 |
| 7,275,889 | B1 | 10/2007 | McGill | |
| 7,314,007 | B2 * | 1/2008 | Su | 102/502 |
| 7,900,548 | B2 * | 3/2011 | Hoadley et al. | 89/36.17 |
| 2003/0098573 | A1 * | 5/2003 | Sonnenberg et al. | 280/743.2 |
| 2005/0016372 | A1 * | 1/2005 | Kilvert | 89/1.34 |
| 2005/0132923 | A1 * | 6/2005 | Lloyd | 102/477 |
| 2006/0140715 | A1 | 6/2006 | Lyddon et al. | |
| 2007/0264079 | A1 | 11/2007 | Martinez et al. | |

* cited by examiner

NON-LETHAL RESTRAINT DEVICE WITH DIVERSE DEPLOYABILITY APPLICATIONS

CROSS REFERENCE TO RELATED APPLICATION

This application is a divisional application of U.S. patent application Ser. No. 12/185,947 filed Aug. 5, 2008, now U.S. Pat. No. 7,882,775 which claims priority in previously filed provisional application 60/963,927, filed Aug. 7, 2007, herein incorporated in its entirety.

STATEMENT REGARDING FEDERALLY SPONSORED RESEARCH

Some elements of this invention were developed under Department of Homeland Security SBIR Contract NBCH060024.

BACKGROUND OF THE INVENTION

1. Field of the Invention

This invention is directed to a system, apparatus and method for the non-lethal restraint of a vehicle, a person, or an animal through the use of an entanglement device that will entangle such vehicle, person or animal. The non-lethal entanglement device incorporates a plurality of tendrils, filaments, tentacles, cables, ropes or straps, or a combination there of, that are propelled from a housing by compressed gas, an explosive charge, a rocket based projectile or by pressure generated by a gas generator of the type commonly used in air bag deployment apparatus. Filaments that are launched from the device may be attached to projectiles that may carry adhesive substances, conductive substances, or barbed capture elements that will adhere, stick or hook onto to a target surface. The filaments are designed to assist in entangling a target vehicle, a target person, or a target animal and restrain the targeted element.

This invention is also directed to a system, apparatus and method for the non-lethal deterrent of a target through the use of a device that will deliver chemical agents or electric shock mechanisms for repelling persons or animals. The non-lethal device incorporates a plurality of projectiles that are propelled from a housing by compressed gas, an explosive charge or by pressure generated by a gas generator of the type commonly used in air bag deployment apparatus. Projectiles may be projectiles, in one embodiment, frangible balls, carrying chemical agents, adhesive or conductive substances or barbed capture elements or a combination thereof that will adhere or stick to a target surface. Filaments may be included to deliver electric shock mechanisms to the target.

The inventors also contemplate using the broad technology disclosed herein in an aquatic environment where the entanglement technology can be used to restrain boats, submarines and other water-borne vessels. The entanglement technology will render the propulsion mechanisms, such as, but not limited to propellers jet-pumps, and screw drives, as well as steering motors and steering equipment such as rudders, and the like of boats, submarines, hovercraft, and other water-borne vessels hydrodynamically inefficient. Such entanglement caused situations will impede the vessel's progress, and in some cases stop the vessel, by fouling propellers, jet-pumps, and other underwater or water-line control surfaces of a vessel.

A further application is to use the non-lethal restraint device as an ancillary device floated on or under the water, in a single or in an array configuration in which the systems intelligently communicate (net centric) to locate a target vessel and activate the closest device to ensnare and disable the target vessel.

The inventor also contemplates that the entanglement device, system and method can be used as a perimeter defense system to deter, restrain, or identify targets by marking with a trackable substance or device, for instance, a paint or fluorescent substance or an electronic tracking device.

In another embodiment the inventor contemplates that the entanglement device, system and method can be launched from a 'launch platform' such as a missile tube, torpedo launcher, sono-buoy launcher, pneumatic launcher, grenade launcher, mortar tube, shotgun, or the like, or by other means, such as, but not limited to, a projectile, mortar, flying disc, remote controlled aircraft, shotgun shell, launched grenade or missile.

A further embodiment is an entanglement device, system and method that is hand launched, thrown, or tossed like a projectile, hand grenade, flying disc bola device, glider or the like. Thus the entanglement device, system and method can be hand-placed, tossed, buried, submerged at a variable depth. It can be configured as a landmine, sea-borne mine, sono-buoy, claymore mine, or 'bouncing betty' mine. Among other configurations.

A further application is to use the non-lethal restraint device as an ancillary device mounted on a riot shield, post, wall, or mounted on crowd control vehicles so that projectiles, such as frangible balls or other such projectiles containing chemical irritants, marking paint, or adhesives, can be launched, either in volleys, in a successive "escalation of force," or in one massive launch event where all the projectiles are launched at once at targeted aggressors.

The inventors also contemplate attaching an electric shock delivery option, such as an electric shock weapon using electro muscular disruption or shaped pulse systems launched or delivered from a protective shield or peripheral defense device. Another option is incorporate an electrically conductive adhesive to enhance the shock delivery mechanism.

Still a further option is to attach entangling fibers to the projectiles launched from the shield, post, vehicle or other mounting mechanism.

2. Description of Related Art

To reduce the complexity and length of the Detailed Specification, and to fully establish the state of the art in certain areas of technology, Applicants herein expressly incorporate by reference material identified in the following publications.

Greg Lucas, "Bay Area's New Efforts in the War on Terror Coast Guard Weapon: High-tech net to keep boats from off-limits areas," San Francisco Chronicle Article, Aug. 10, 2005. (Available on the Internet.).

Honeywell Spectra Technical Bulletin, HON-PF-PS10, (Available on the Internet).

Steven H. Scott, "Sticky Foam as a Less-Than-Lethal Technology," Sandia National Laboratory, US DOE Contract No DE-AC04-96AL8500, CIRCA 1994.

T. D. Goolby and K. J. Padilla, "Sticky Foam Restraining Effectiveness Human Subject Tests for the Less-Than-Lethal Foam Project," Sandia Report, Jul. 8, 1994 UNCI (Available on the Internet).

The applicants believe that the material incorporated above is "non-essential" in accordance with 37 CFR 1.57, because it is referred to for purposes of indicating the background of the invention or illustrating the state of the art. However, if the Examiner believes that any of the above-incorporated material constitutes "essential material" within the meaning of 37 CFR 1.57(c)(1)-(3), applicants will amend the specification to expressly recite the essential material that is incorporated by reference as allowed by the applicable rules.

BRIEF SUMMARY OF THE INVENTION

The present invention provides, among other things, an apparatus and a method for restraining, marking, deterring, or rendering inefficient targeted land or water borne vehicles. It may also be used to restrain humans or animals depending on the designed application and embodiment taught by the general operating principles of the invention. It may also be useful in to mark an intruder with paint or other material for subsequent identification or to launch a deterrent such as a projectile or ball containing a chemical irritant or an adhesive.

In one embodiment of the invention the activation hardware and the ensnaring elements are carried on or in a truncated cylindrical housing. This housing presents a small, light, self-contained propulsion unit for the entanglement device.

The method of entangling, or otherwise engaging, a target may be accomplished by providing an entangling apparatus having a housing; a barrel, in some embodiments; a pressure generator; and a projectile, which may be a frangible ball in some embodiments; and attached tendril. The entangling apparatus is then positioned in an expected path of a target and armed for use. When a target vehicle is being driven over the entangling apparatus, pressure generation is initiated. The pressurization will cause the launching of the projectile from the barrel of the entangling apparatus. The launched projectile will contact the target vehicle with the frangible ball, projectile, and/or the tendril of the projectile causing entanglement of the target vehicle with the tendril of the projectile through relative motion of the target vehicle and the tendril.

It is an object of the invention to provide non-lethal restraint, deterrent, marking, tracking system that will restrain a moving vehicle, a person, or an animal.

It is also an object of the invention to provide a non-lethal restraint device that can be deployed from a land-based, water-borne, or air-borne platform.

It is also an object of the invention to provide a non-lethal restraint device that can be deployed by being manually dropped, placed, buried or otherwise positioned.

It is a further object of the invention to provide a device having the capability of launching a tracking device.

It is also an object to provide a water-borne immobilization device that can be used to restrain or disable a water-borne vessel.

It is also an object to provide a water-borne immobilization device that can be used to foul the propulsion system of a water-borne vessel and render it hydrodynamically inefficient.

It is also an object of the invention to provide automatic arming and triggering systems for arming and discharging the device so that the device can perform with minimal user intervention.

It is also an object of the invention to provide a non-lethal immobilization device that is small, compact, reloadable and reusable.

It is also an object to have a non-lethal immobilization device that can be positioned by being dropped from an aircraft or deploying the device from a moving vehicle without damage to the device.

It is also an object of the invention to have a device that can be remotely armed from a safe distance from the expected path of a target.

It is another object of the invention to configure the entanglement device for use as a riot control tool by mounting the entanglement device or other crowd control products, such as pepper balls or other projectiles containing chemical agents, adhesives, or the like on a shield, post, or vehicle used in interacting with multiple aggressors.

It is another object of the invention to configure the entanglement device to launch projectiles containing or coated with noxious chemical agents, capsaicin based products, adhesives, or the like.

A further object of the invention is to configure the device for use against multiple targets using a staged launch scenario for increasing the severity of the device's effect.

A further object of the invention is to provide a non-lethal device that is used for perimeter security by discharging projectiles or frangible balls containing paint, fluorescent paint, or marking powder to render an intruder visible to law enforcement personnel.

It is another object of this invention to provide a non-lethal land mine capable of launching an entanglement device, a frangible ball, a projectile, or any combination of launchable elements.

Another object of the invention is to provide a method of entangling a target with a tendril using relative motion of the target and the tendril to effect entanglement.

It is another object of the invention to provide a non-lethal vehicle restraint undercarriage immobilization device that can accommodate a range of targeted vehicle masses over a wide range of velocities.

It is another object of the invention to provide a non-lethal vehicle restraint device that is operative and effective for use on vehicles of various heights and drive train types.

The above and other objects may be achieved by providing non-lethal restraint system including a housing having an exterior surface and having a pressure manifold inboard of the exterior surface of the housing. The housing includes at least one barrel extending from the exterior of the housing to the pressure manifold and a pressure generator or stored source of pressure or compressed gas, such as, but not limited to a carbon dioxide cartridge, carried in the pressure manifold. A projectile carried in the barrel has a spool, a tendril wound on the spool and a frangible ball or other projectile connected to the tendril. It is expected that a large number of barrels will be provided in each housing.

Another way of achieving the above and other objects of the invention is through an apparatus for non-lethal ensnarement of a target having a housing with an exterior surface and a pressure manifold inboard of the exterior surface of the housing. A first pressure generator or stored source of pressure, for accomplishing a first event is carried in the housing. There is a primary tubular strap, rope, or cable in communication with the first pressure generator and a first activation device in communication with the first pressure generator. In one embodiment of the invention an alternative propulsion source may be used to deploy the ensnarement package, for instance, a rocket incorporating propulsion protocol may be more effective in deploying a heavier strap package.

The immobilization apparatus will include a pressure generator carried in the housing and a set of barrels containing projectiles in communication through a manifold to the pressure generator. The event apparatus includes a set of leader tendrils connected at the trailing ends of the leader line. A frangible ball or projectile is attached to the leading end of the leader line. An activation device, in communication with a pressure generator, is used to initiate the pressure generator.

The above and other objects may be achieved by using methods of entangling a target as set forth in this disclosure.

The method may be accomplished by providing an entangling apparatus having a housing, a barrel, a pressure generator, and a projectile having a frangible ball or projectile and attached tendril. The entangling apparatus is then positioned, launched, or otherwise deployed in an expected path of a target. The apparatus can then be armed for firing. When a target is in the proximity of the entangling apparatus, pressure generation is initiated. That is the device is 'fired." The pressurization will cause the launching of the projectile from the barrel of the entangling apparatus. The launched projectile will contact the target with the projectile, the frangible ball, or the tendril of the projectile causing entanglement of the target with the tendril of the projectile through relative motion of the target and the tendril.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. §112, ¶6. Thus, the use of the words "function," "means" or "step" in the Detailed Description or Description of the Drawings or claims is not intended to somehow indicate a desire to invoke the special provisions of 35 U.S.C. §112, ¶6, to define the invention. To the contrary, if the provisions of 35 U.S.C. §112, ¶6 are sought to be invoked to define the inventions, the claims will specifically and expressly state the exact phrases "means for" or "step for, and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. §112, ¶6. Moreover, even if the provisions of 35 U.S.C. §112, ¶6 are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

BRIEF DESCRIPTION OF THE SEVERAL VIEWS OF THE DRAWINGS

A more complete understanding of the present invention may be derived by referring to the detailed description when considered in connection with the following illustrative figures. In the figures, like reference numbers refer to like elements or acts throughout the figures.

LAND VEHICLE RESTRAINT

In one application of the invention the non-lethal restraint or undercarriage immobilization device will be positioned for use by placing the undercarriage immobilization device, either by hand in the expected pathway of a vehicle to be stopped or by dropping the undercarriage immobilization device from a moving vehicle such as an automobile, truck, or helicopter. With the undercarriage immobilization device placed on the ground it can be safely armed. Arming of the device can be performed by closing a switch on the housing or from a remote location. Once armed the undercarriage immobilization device is ready for use. As the target vehicle approaches the undercarriage immobilization device, inflatable primary straps, ropes, or cables will be deployed, in one embodiment by inflating the hollow straps, or bladders so that these primary straps ropes or cables are unfurled across the road surface. As the target vehicle drives onto or over the primary straps, the tires of the target vehicle will engage the primary straps which will connect to the tires, either through an adhesive carried on the surface of the primary straps or through hooks or spikes strategically placed on and carried by the straps. At this point the primary straps are attached to the vehicle tire or other component of the moving vehicle. The primary straps will wind around the suspension and other structures on the underside of the target vehicle and pull tight or wedge between components creating a fixity for the strap. Meanwhile, and almost simultaneously therewith, while the target vehicle is still passing over the undercarriage immobilization device an infrared sensor, or other sensor capable of sensing the vehicle, on the undercarriage immobilization device will sense the presence of the target vehicle and initiate launching of an array of projectiles and leader tendrils connected to the secondary straps. These leader tendrils will ensnare rotating components of the target vehicle and as they do the leader tendrils will draw the secondary straps, carried on the base of the undercarriage immobilization device, into engagement with and around rotating components of the target vehicle. These secondary straps will pull the strap package, that is the inflatable primary straps and the secondary straps, to the extent other secondary straps have not already separated from the reusable base of the device, off of the reusable base of the undercarriage immobilization device. The high elongation secondary straps, and the primary straps, to the extent they have wrapped around moving components on the underside of the target vehicle, will absorb kinetic energy from the moving target vehicle. The target vehicle will slow at a controllable rate due to the entanglement of the straps with the rotating or moving parts of the vehicle and eventually cause the vehicle to stop.

Figure 1:
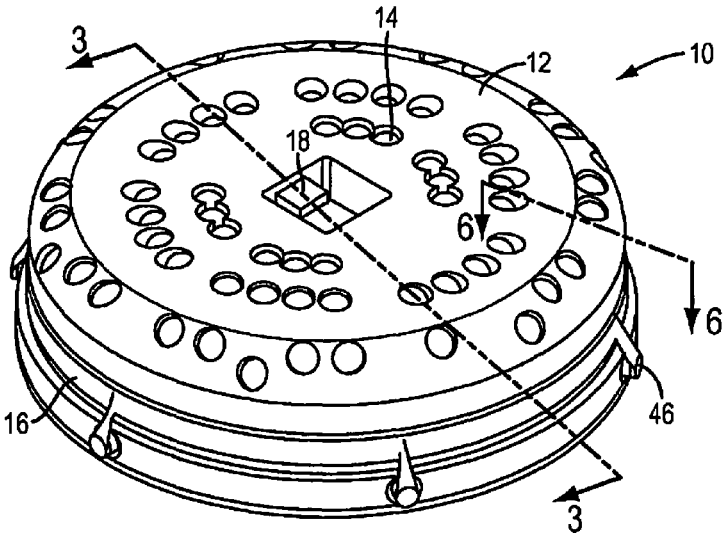
FIG. 1 depicts an embodiment of an immobilization device.

Turning first to FIG. 1, the undercarriage immobilization device is shown generally as item 10. The device includes a housing 12 with numerous barrels, such as 14, a strap package 16 and a proximity detector and actuation device package 18. The housing 12 is sometimes referred to as the propulsion device in the description of several embodiments presented herein.

Figure 2:
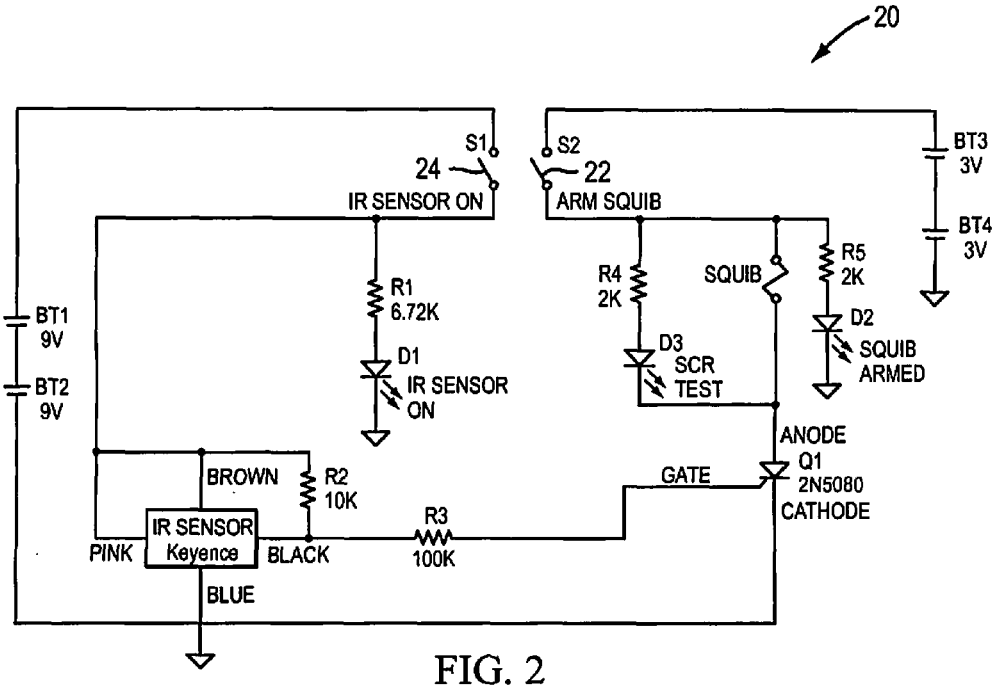
FIG. 2 is an schematic of the actuation circuit used to control the immobilization device shown in FIG. 1.

FIG. 2 is an electrical schematic of a triggering circuit, shown generally as item 20. This circuit includes a switch 22 to arm the undercarriage immobilization device and a remote signal responsive switch 24. The switch 22 can be closed manually or remotely by an operator controlling the device.

Figure 3:
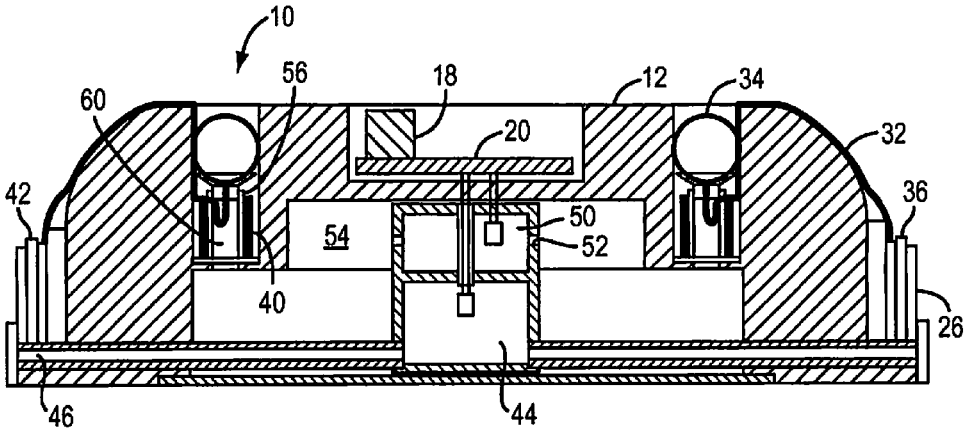
FIG. 3 is a simplified cross-sectional view through plane 3-3 of FIG. 1 pictorially showing the interior of the device of FIG. 1.

FIG. 3 is a simplified cross-sectioned view of the immobilization device taken through plane 3-3 of FIG. 1. Some components have been left out of this figure for clarity. This pictorial representation of the device shows one embodiment of the invention. The housing 12 will contain a proximity and actuation device package 18 that is in communication with the triggering circuit board 20. This board is shown as a schematic in FIG. 2. A primary gas generator chamber 44 is electrically connected with the triggering circuit generally 20.

A set of ports, or pressure delivery conduits, such as 46, extend from the primary gas generator chamber 44 to input ends of at least one strap or a plurality of inflatable primary straps 26. Upon actuation and the discharge of gas from the primary gas generator 44 the event one ground straps 26 will be deployed to the position shown in FIG. 4.

In FIG. 3 a secondary gas generator chamber 50 is shown. This chamber 50 has ports such as the ports 52 that connect the chamber 50 to a manifold 54. The manifold 54 provides communication to a plurality of percussion chambers 60, each associated with a projectile 34 and spool assembly 40 on which leader tendrils are wound. The leader tendrils 32 are attached at one end to the projectile 34 while the tail end of the leader tendrils are attached to a second event strap or secondary flat strap 36. The leader tendrils will be strong filaments of line capable of significant tensile strength. The projectiles 34 are carried on a support having a surface on an extended portion of the support, the extended portion of the support on which the projectile is carried being a sliding fit in a projectile guide 56 of a launch chamber 60. A band 42 will hold the secondary straps 36 on the propulsion housing 12 after the primary straps 26 are deployed in event one and before the secondary straps 36 are deployed with the leader tendrils 32 attached to them in event two.

The projectiles shown in FIG. 3 may be directly connected to the manifold 54 to be launched by gas pressure generated by the secondary gas generator 50. In another embodiment the pressure in the manifold 54 from the secondary gas generator 50 will be used to actuate a percussion or gas generating device carried in the projectile itself or the chamber hosting the projectile. The percussion device could be an explosive charge such as an explosive cartridge or a compressed gas device, either of which, when actuated, is capable of launching individual projectiles such as plastic devices, rubber or rubber like devices, frangible balls, or metallic or non-metallic devices and the attached leader tendrils 32.

The flat secondary straps, ropes, or cables 36, which are attached to one or more of the leader tendrils 32, are expected to be too heavy, in most configurations, to be pulled by the projectile itself. Therefore the leader tendrils 32 will be long enough, on the order of greater than a foot long and not much longer that about fifteen feet long, and strong enough to entangle with the rotating components of a target vehicle. Once entangled the leader tendrils will drag the flat secondary straps into entanglement with the rotating elements of the target. In another embodiment the leader tendrils will simply attach themselves to the vehicle and allow the attached secondary straps to get wound up in the running gear of the vehicle.

Figure 4:
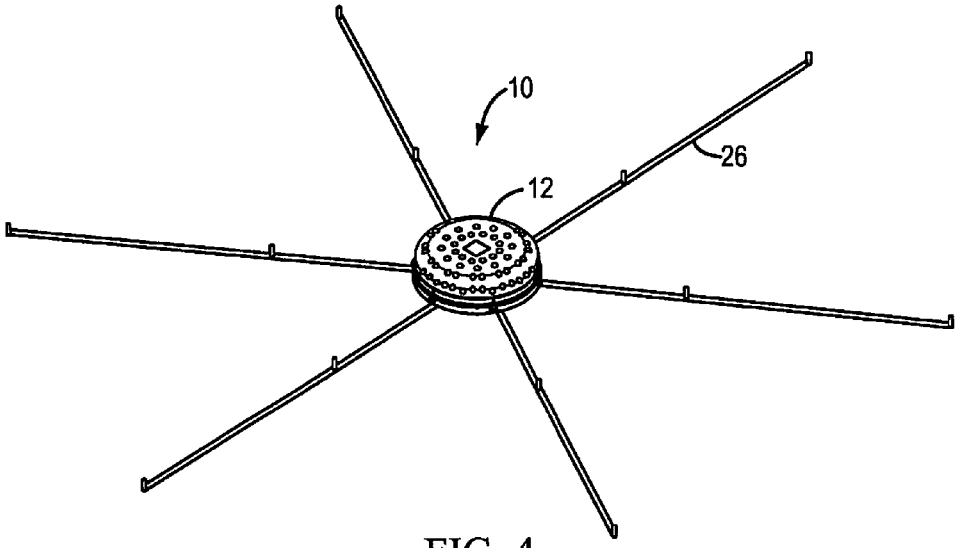
FIG. 4 depicts the immobilization device after a first event activation as used as an undercarriage immobilization device.
Figure 5:
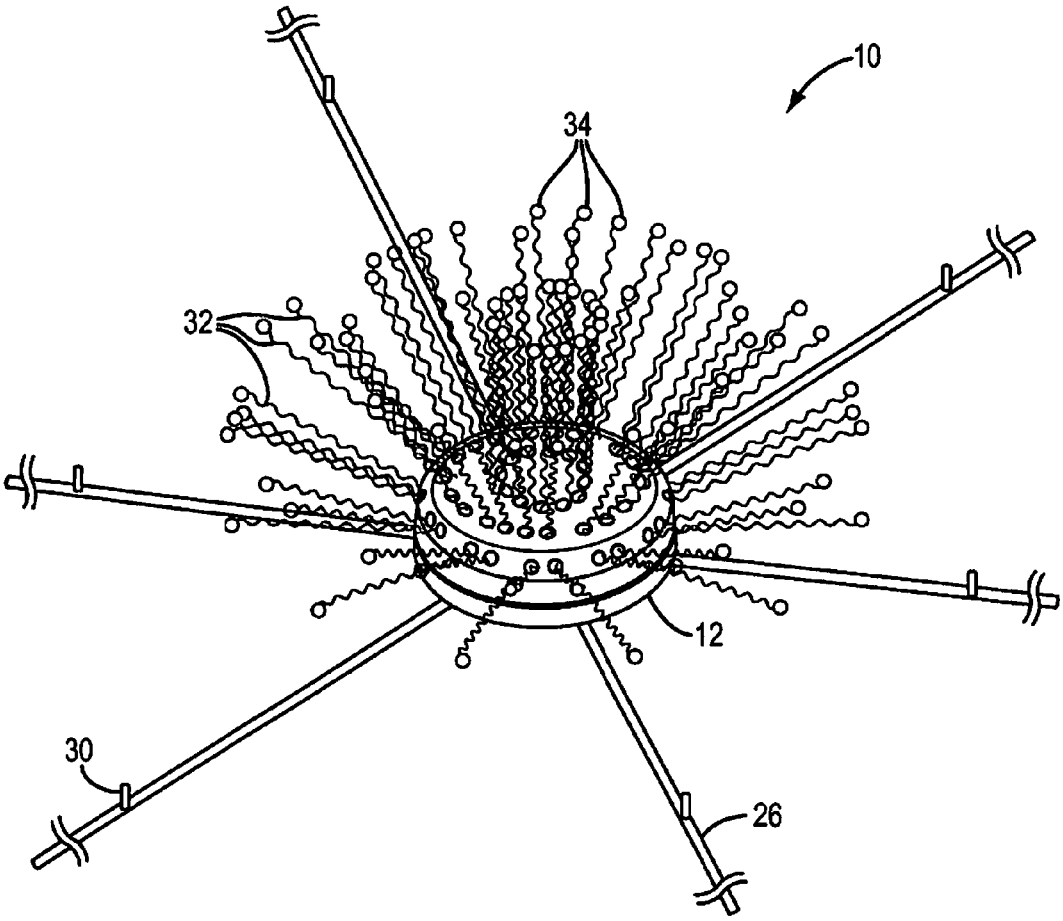
FIG. 5 depicts the undercarriage immobilization device of FIG. 4 partway through a second event activation.

FIG. 4 shows the undercarriage immobilization device generally 10 after completion of the event one in the deployment of the device. Here a plurality of inflatable primary straps, such as primary straps 26, are deployed in a wide area around the housing 12. These primary straps 26 are deployed after placement of the undercarriage immobilization device in a desired location. The straps may be tubular structures of high strength fabric, with or without an internal impervious, elongated bladder, that are wrapped, in one embodiment of the invention, in an overlapping fashion around the perimeter of the undercarriage immobilization device in the center vertical section of the device. These primary straps 26, in one embodiment there will be six straps, other embodiments may have more or less than six straps, per undercarriage immobilization device, will unfurl when they are inflated using gas generated from the primary gas chamber 44 of FIG. 3. The primary straps 26 will form a grid of straps as shown in FIGS. 4 and 5. These straps 26, will be fitted with upwardly extending barbs, spikes, hooks, attachment devices, including but not limited to adhesive patches, that can quickly attach to a rolling vehicle tire. The barb or spike embodiment is shown as item 30 in FIG. 5. A plurality of barbs, spikes or other attachment devices may be mounted to each primary strap 26. Each of these adhering devices is capable of attaching the primary straps 26 to a tire of a vehicle being driven over the deployed primary straps. To begin the restraining action of a target vehicle these primary straps 26 will attach to the vehicle's tire by connection through the barbs, spikes, adhesives, or the like and rotate with the tire for at least a portion of a tire revolution and thus bring the primary strap that is stuck to the tire up into the undercarriage of the vehicle.

FIG. 5 shows the device with the primary straps 26 extended. It also shows a plurality of leader tendrils such as 32 deployed from the housing 12 of the device generally 10. Each of these leader tendrils 32 is attached to a projectile, such as, but not limited to, an adhesive filled frangible ball 34 that was launched from the housing 12. The leader tendrils 32 are attached to the flat secondary straps 36, not yet deployed in FIGS. 3-5 but shown in FIG. 3 as secondary straps 36. These secondary straps 36 are used to entangle the target vehicle, as are the primary straps in this embodiment.

As shown in FIG. 3 the leader tendril 32, having a projectile 34 attached at one end thereof, is also attached, at a second end, to the secondary strap 36. In one embodiment there will be several leader tendrils such as 32 attached to a single secondary strap such as 36.

The deployment of the primary 26 and secondary 36 straps is accomplished in two phases or events using two separate deployment charges.

The first event is the deployment of the inflatable primary straps after the device is positioned for use. For the deployment of the primary straps in event one a primary gas generator can be used. The gas generator will be activated by an operator from a remote location through use of a actuation device which is part of the proximity detector and actuation device package 18. By rapidly filling the tubular primary straps with gas generated in the primary gas generator the straps will unroll from their stored position on the housing shown in FIG. 1 to the deployed position as shown in FIG. 4 and the other figures.

Event two in the use of the non-lethal restraint device is the deployment of the secondary straps and leader tendrils that will ensnare the undercarriage of a target vehicle. This second event can be initiated as the primary straps are picked up by the vehicle or, alternatively, when the primary straps are not picked up by the vehicle tires, but when the secondary straps are deployed based on a signal from a proximity detector or from a signal sent by an operator using a remote actuator.

As stated above, the activation device for activating the gas generator in event two can be an automatic device sensing the presence of the target vehicle such as, but not limited to a laser based, sonar based or other proximity detector, or by a human equipped with a remote activator to send a signal to the housing to activate the gas generator or by interaction between the primary straps and the device. Any one of these methods can be used to activate the gas generator to activate and launch the projectiles 34 and the tendrils 32 from the housing 12.

Figure 6A:
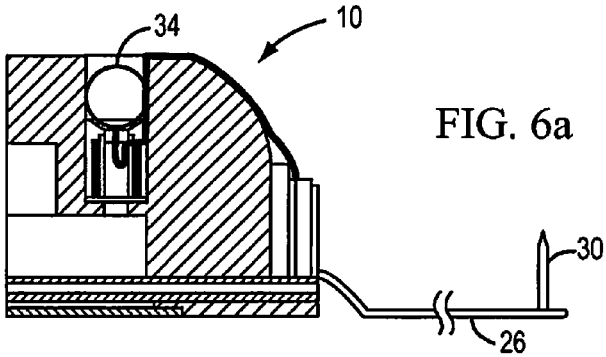
FIGS. 6*a* through 6*c* is a series of pictorial cross sectional representations of event one and event two launch sequences of the undercarriage immobilization device being deployed.
Figure 6B:
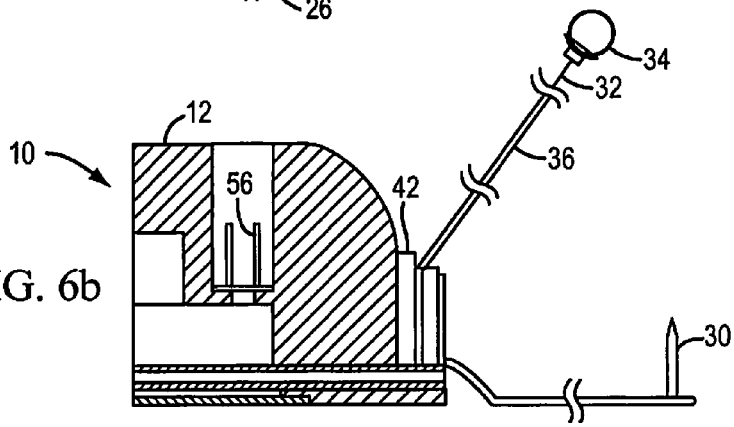
Figure 6C:
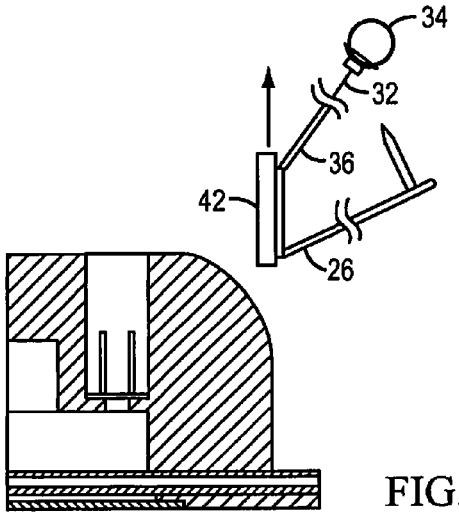

FIGS. 6*a-c* are cross sectional pictorial representations, with some parts removed for clarity, taken through plane 6-6 of FIG. 1.

FIG. 6*a* shows a partial cross section of a portion of the undercarriage immobilization device 10 showing a event one ground strap or primary strap 26 extending outwardly from the housing 12 of the immobilization device. In this figure the undercarriage immobilization device 10 has been activated through initiation of event one, which is the event where the primary straps are deployed from the propulsion housing 12. In this embodiment, a spike 30 is shown projecting from the top of the primary strap 26.

FIG. 6*b* pictorially shows an "in progress" event two deployment after the second event activation of the immobilization device 10. The projectile 34 and the attached tendril 32 are shown attached to a secondary strap 36. This secondary strap will not be dragged from the housing only by the launch of the projectile but will be dragged off the housing by the tendril 32 after the tendril has made an entangling or adhesive connection with a target vehicle. At this time the primary ensnarement mechanism will be attached to the vehicle (the vehicle is not shown in this figure for clarity).

FIG. 6*c* shows the immobilization device with the primary straps such as 26 and the secondary straps, for instance 36, being deployed and leaving their stored location on the housing 12. The inflatable primary straps 26 were launched from the housing generally 10 using a compressed gas propellant that will launch the primary straps 26. These primary straps 26 are shown in a ready to be deployed position in FIGS. 1 and 3 and in a deployed position in FIGS. 4, 5 and other figures. The secondary straps 36 are deployed through their attachment to the leader tendrils 32. The leader tendrils 32, attached to the projectile 34, are launched with the projectile. As shown in FIGS. 3 and 6*a-c*, the leader tendrils such as 32, are attached to secondary straps 36. Several leader tendrils may be attached to each secondary strap or a single leader tendril may be attached to a single secondary strap. The secondary straps 36 are wound stacked, or folded, for example, around the housing 12 under, or in close proximity to, the primary straps 26 and attached to the band 42 and will be deployed as they are pulled by the leader tendrils and rotating structures of the vehicle that the leader tendrils and the primary straps have attached themselves to.

The primary straps 26 and the secondary straps 36 will entangle themselves on a target vehicle as the target vehicle moves over the undercarriage immobilization device 10. First the primary straps 26 will attach to the tires as the tires drive over the strips and get attached by the use of barbs or the spikes, such as 30, or adhesive material located on the surface of the inflatable primary straps. Next the secondary straps 36, attached to the leader tendrils 32, are launched, within less than seconds of the primary straps being picked up by the tires of the vehicle, the secondary straps will start to entangle on the underside of the vehicle. Where the projectiles such as 34 are frangible balls filled with adhesive, the adhesive of the frangible balls, assisted by barbs if the frangible balls also included barbs carried inside or on the surface of the projectile, may stick to the underside of the vehicle and the straps attached to the leader tendrils will, when the leader tendrils are attached to the vehicle, entangle themselves, the secondary straps and the primary straps, with the vehicle. The entangled primary straps 26 and the entangled secondary straps 36, or each, either, or any of them, will be stripped off the housing of the immobilization device and become entangled with the target vehicle running gear. The primary straps 26 and secondary straps 36 are sewn or otherwise attached to a circular band 42 so that the strap package will be removed as a set or package of straps from the housing and the strap package will remain with the entangled target vehicle. In this way the strap package will continue to wrap itself around moving parts of the target vehicle while the housing will be left behind to be collected and reloaded for subsequent use.

The inventor has found that a gas generator of the type used in automotive airbag deployment systems that has been integrated into the device provides a good source of pressurized gas for deploying the primary and secondary straps.

Figure 7A:
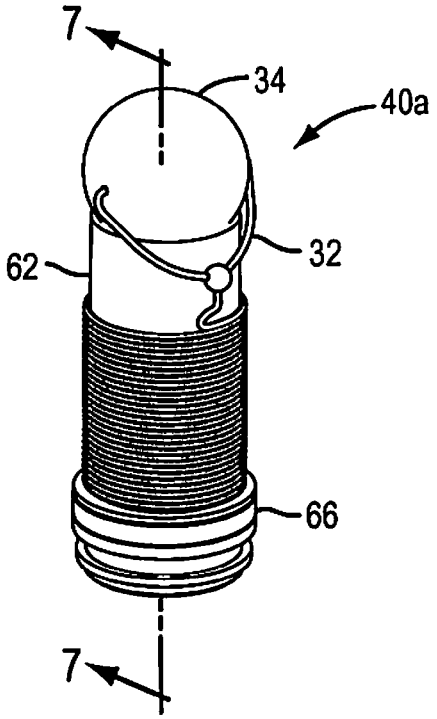
FIG. 7*a* is a representation of a launchable spool and projectile element.
Figure 7B:
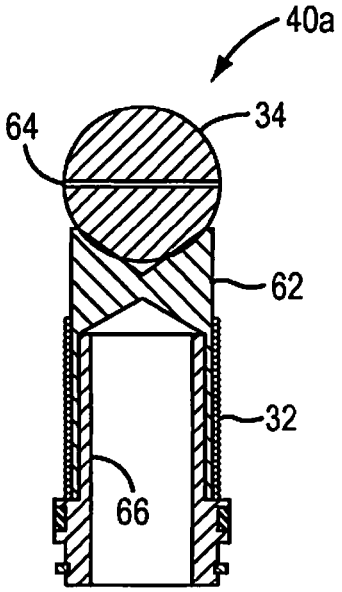
FIG. 7*b* is a cross sectional view through 7-7 of FIG. 7*a;*
Figure 8:
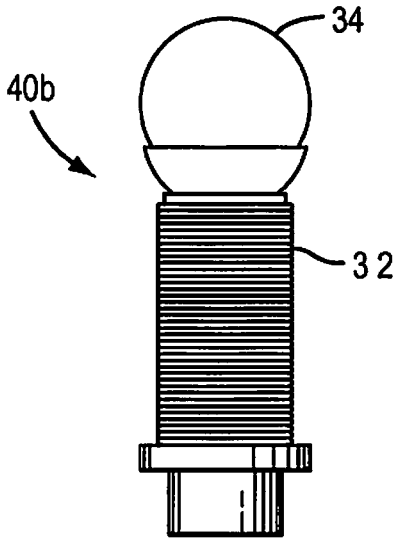
FIG. 8 is representation of the spool and projectile element used in FIG. 1.

FIG. 8 is a depiction of a projectile positioned on a launch tube as is used in the FIG. 1-6 embodiments of the immobilization device. This spool and projection element has a base that is received in the propulsion housing 12. A leader tendril 32 is wound around the spool, in this case the spool is also the launch tube and the tendril is attached at one end to the projectile 34. This embodiment is different from the FIG. 7 embodiment, described below, in that the launch tube remains with the propulsion unit 12 and is not launched with the projectile 34. The other end of the tendril attached to the projectile 34 may be attached to a secondary extendible line or strap 36 as described above. In some applications or embodiments the tendril remains connected to the spool body rather than being attached to a secondary strap.

FIGS. 7*a* and 7*b* show another embodiment of a projectile launch tube. The projectile 34 is attached to the leader tendril 32 wound on a launchable spool 62. When the projectile 34 is launched the projectile 34 will pull the leader tendril from the launchable spool 62. The projectile 34 may be a mass element, either a plastic, rubber or rubber like element, or it may be a frangible ball encapsulating an adhesive, a barb or hook element, or both, to assist entangling a rotating component of a target vehicle.

FIG. 7*b* is a cross sectional view of FIG. 7*a*. In this view the projectile 34, having a through bore 64 is positioned on the launchable spool 62. The launchable spool 62 provides a storage location for the tendril 32. The tendril is wrapped around the launchable spool 62 in a way that will allow easy unspooling as the projectile 34 pulls the tendril 32 off the launchable spool 62. The second end of the tendril is attached, in one embodiment, to a strap or other extendible line. Such extendible line will be pulled from a storage location by the tendril. In this configuration when the projectile 34 is launched the launchable spool will be launched off a hollow cylindrical base 66. Upon launch the base 66 remains with the launch propulsion device but the launchable spool 62, projectile 34 and tendril 32 will all be launched together. As the projectile 34 and launchable spool 62 travel in its launch path the tendril 32 will unwind from the spool and the spool will fall to the ground. It has been found that launching the launchable spool 62, having an elongated hollow body, from the base 66, which also has an elongated hollow body, provides directional stability over the launch of a projectile alone, as is done in the FIG. 8 embodiment. This is because the tube-in-tube relationship shown in FIG. 7*b* acts as a barrel that elongates as the propulsion charge fills the interior cavity of the base 66 and the launchable spool 62. This provides almost double the length of the barrel and extends the time duration for improved stability and guidance during the launch of the projectile 34 as compared to a device that doesn't have a tube-in-tube configuration.

FIGS. 30 through 34*c* present another embodiment of the invention. It is similar to the device shown in FIGS. 1 and 3 with the major differences being the straps, the strap packaging and manifolds for supplying pressure to deploy the strap package.

Figure 30:
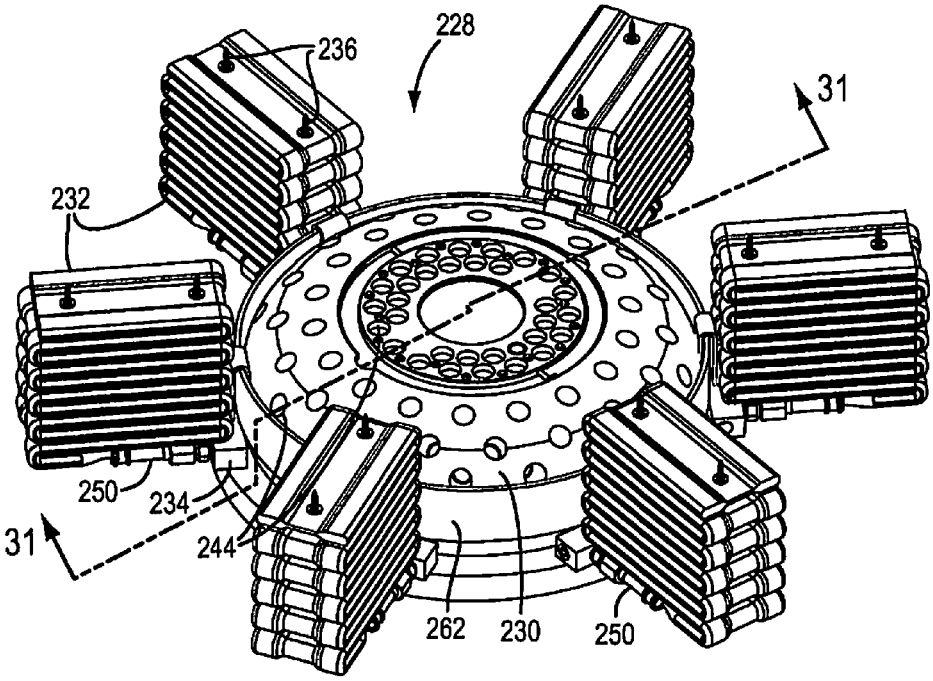
FIG. 30 is another embodiment of a non-lethal vehicle restraint device having straps mounted in stacks at the periphery of the units propulsion section housing.

Turning first to FIG. 30, a non-lethal vehicle restraining device, generally 228 includes a housing 230. A set of straps, two of six such straps identified as 232, are connected by manifolds, one of the six manifolds in this embodiment shown as 234, to the housing 230. As will be described further on, these manifolds will be pressurized by pressurized gas generated by a gas generator upon activation of the device. The straps 232 will include spikes 236 as shown in FIGS. 30, 31 and 34.

Figure 31:
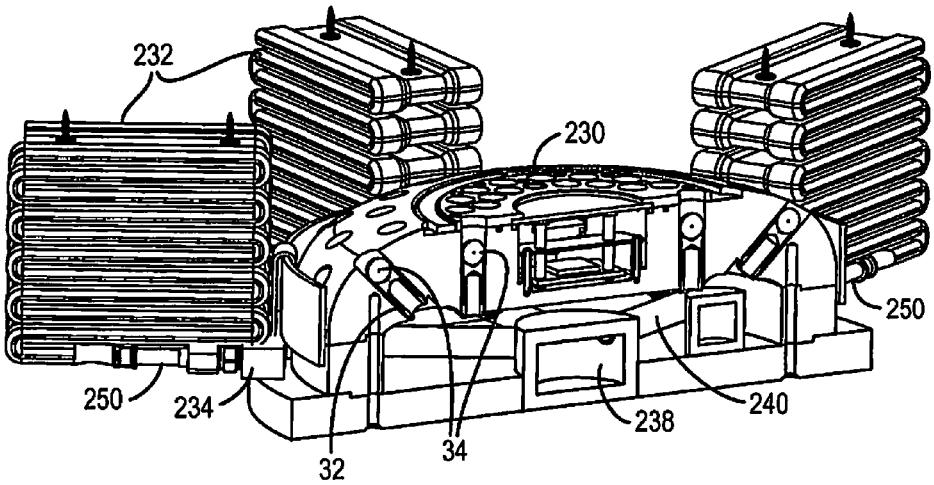
FIG. 31 is a cross sectional view through plane 38-38 of FIG. 30.

FIG. 31 is a cross-sectional view of the device shown in FIG. 30. In this view the strap packages are shown as are the manifolds as represented by 234. The manifolds will be in communication with passages, such as passage 240 formed in the housing, or in an alternative embodiment a separate piece of conduit, leading from a gas generation chamber 238. Pressurized gas will pressurize the passage 240, the manifolds 234 and eventually inflate the straps 232 of the strap package. In this embodiment, where there are six straps, all the straps will be inflated upon the gas generator being activated.

In the embodiment shown in FIGS. 30-32, et al. there are projectile launch tubes such as two of many shown as launch tubes 244. These launch tubes will contain projectiles 34 and tendrils 32 of the type described above and in particular of the type shown in FIGS. 7*a* and 7*b*. These projectiles will be launched in the event two activity of the actuation of the device 228. In event one the straps will be inflated and positioned in a pattern surrounding the housing 230 similar to the strap deployment as shown in FIG. 4.

Figure 32A:
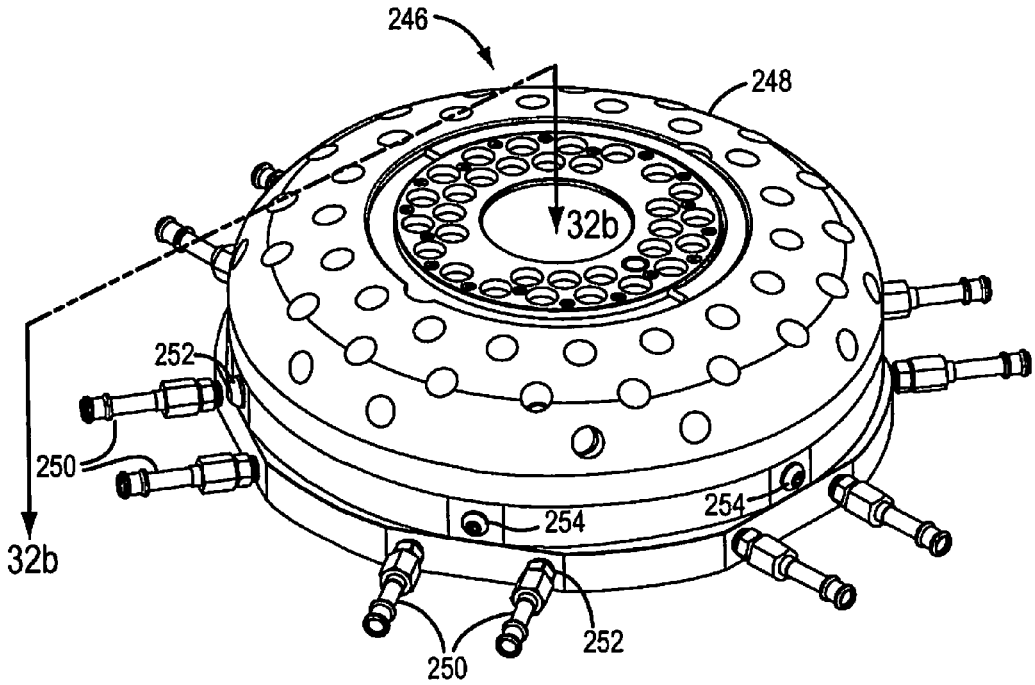
FIG. 32*a* is another embodiment of a non-lethal vehicle restraint device having strap manifold fittings threaded in to the housing of the device.
Figure 32B:
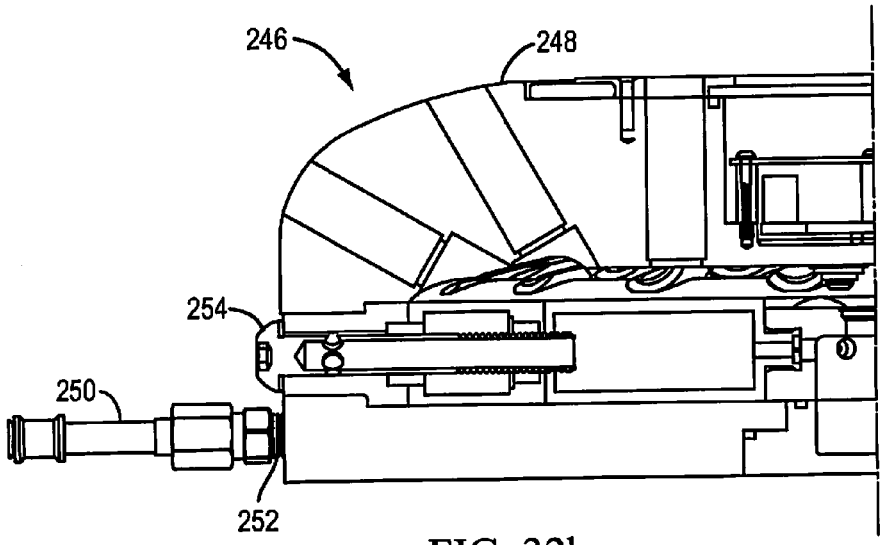
FIG. 32*b* is a pictorial sectioned view of the device of FIG. 32*a;*

FIGS. 32*a* and 32*b* show an embodiment of a non-lethal vehicle-restraining device, generally 246, similar to FIGS. 30 and 31 with a different manifold-to-strap arrangement. In this embodiment the housing 248 includes a plurality of strap interface fittings such as 250, which are threaded into access ports such as 252 in the housing 248 to line up with internal passages that connect the fittings to the gas pressure generator and the source of pressure that is used to inflate the straps such as those shown as 232 in FIG. 30. In this embodiment primary access ports 254 are plugged with hollow screws/manifolds that port gases to lower internal passages. These are some of the differences between this embodiment and the embodiment of FIG. 30.

Figure 33A:
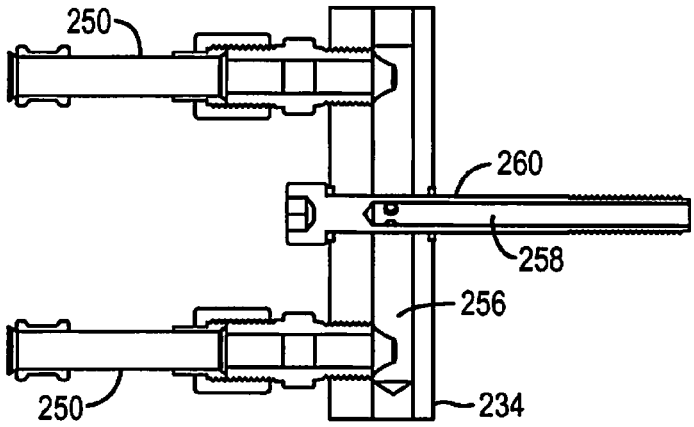
FIG. 33*a* is a pictorial sectioned view of a representative gas delivery manifold as used on the device of FIG. 31.
Figure 33B:
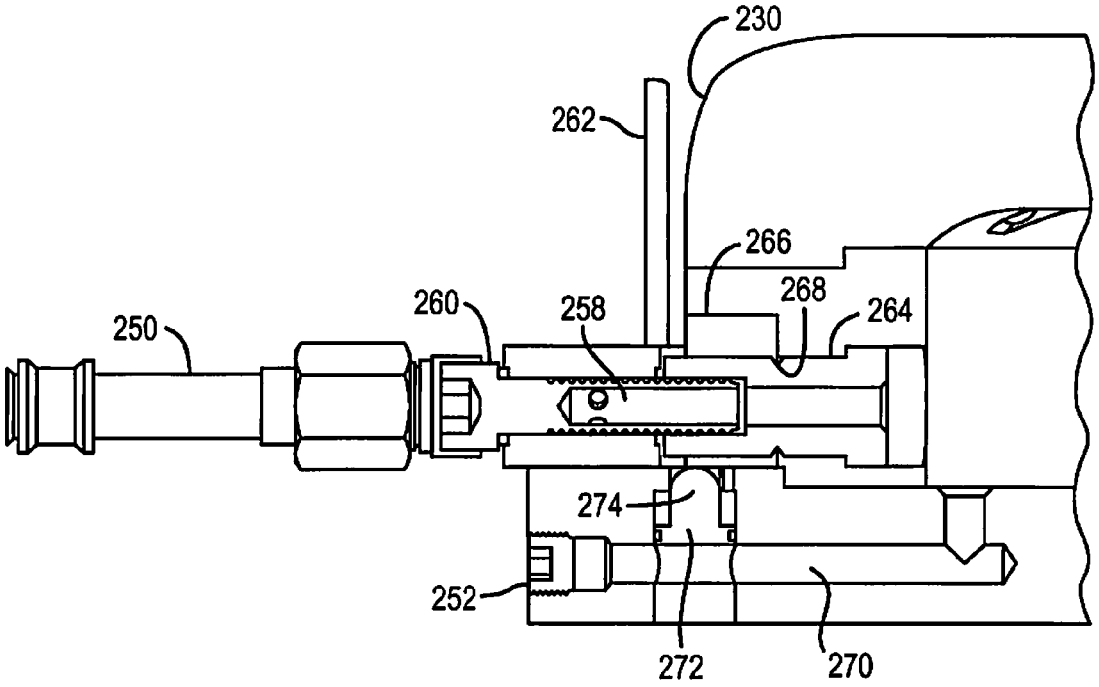
FIG. 33*b* is a partially sectioned view of a portion of the device of FIG. 31 with some parts removed for clarity.

FIGS. 33*a* and 33*b* are related to the embodiment shown in FIGS. 30 and 31 where the exterior manifolds 234 are used. One feature of the manifolds 234 is that they have a "breakaway" capability. FIG. 33*a* is a schematic cutaway view of a plan view of the manifolds 234. The strap interface fittings 250, similar to those used in the FIGS. 32*a* and 32*b* embodiment, are threaded into the manifold block 234. They are in communication with passages 256 in the manifold block 234 and passage 258 formed in a drilled bolt 260. These gas transmission passages are passages used to supply pressurized gas to the straps to inflate them. The drilled bolt 260 is threaded into a receiver 264. This receiver 264 provides a fracturable element that will allow the manifolds 234 and the attached strap package to be released from the housing 230 after the strap package is deployed. By releasing the straps after they are deployed the housing 230 will not be pulled into contact with a target vehicle or dragged along the ground by an engaged strap package.

FIG. 33*b* shows some details of the fracturable element of the manifold. Receiver 264 is threaded to accept the bolt 260. The receiver 264 includes a fracture point 268 that, when fractured, allows the manifold 234 and the bolt to be pulled out of the housing 230. Fracturing of the receiver 264 is accomplished by gas pressure delivered to bore 272, which will drive fracture inducing element 274 against the side of the receiver 264. The front portion of the receiver 264 will be driven upwardly into the space 266 (element 262 will not interfere with the upward movement of the broken off portion of the receiver) allowing the interior threaded end of the receiver, the manifolds 234 and the straps 232 to become disconnected from the housing 230.

Figure 34A:
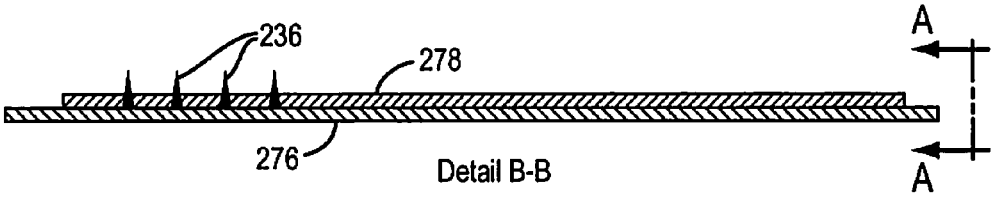
FIG. 34*a* through 34*d* are various views of the straps used in FIG. 31.
Figure 34B:
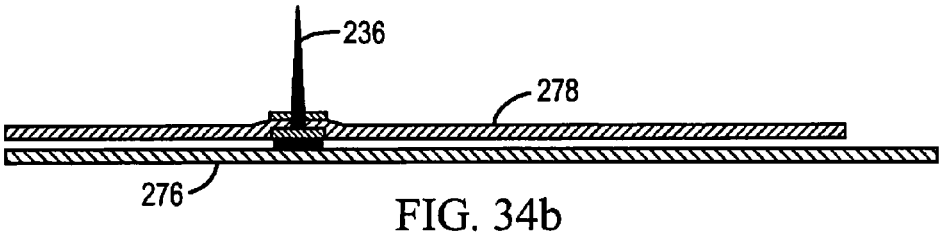
Figure 34C:
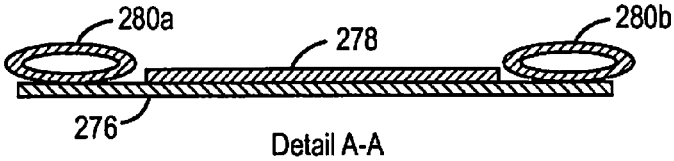
Figure 34D:
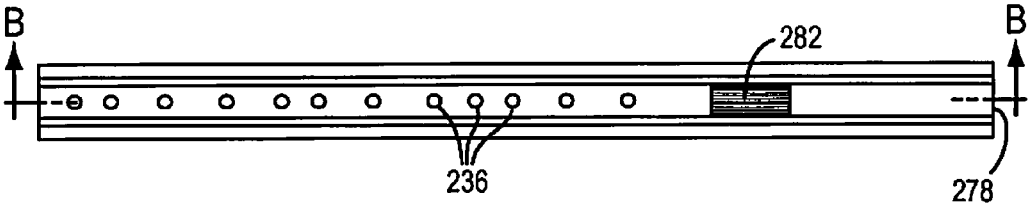

FIGS. 34*a-d* are pictorial representations of a typical strap 232 used in the embodiment shown in FIG. 30. FIG. 34*d* shows a strap in a plan view after it has been inflated and positioned on the ground ready for use. The strap will include a base portion 276 (FIG. 34*c*). Carried on the base portion is a flat strap, tendril, or rope element 278 that is equipped with the spikes 236. FIG. 34*c*, a cross section through A-A, shows the base 276, the woven strap portion 278, and gas receiving tubes, or bladders 280*a* and 280*b*, which may have internal bladders to retain gas sourced into the tubes, although this is usually unnecessary as the tubes are filled quickly and deployed quickly. These tubes are attached to the strap interface fittings 250 in FIGS. 30-33 and may be held in place by clamps. The strap may be folded in the accordion pattern shown in the FIG. 30 embodiment ready for inflation and deployment. FIG. 34*d* shows a zone 282 where extra strap material can be provided to provide for slack during the deployment of the straps.

Figure 24A:
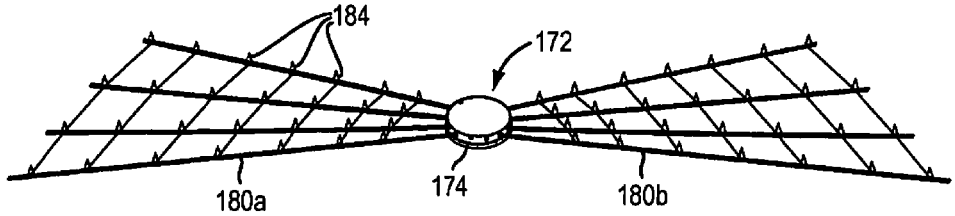
FIG. 24*a* a is a further embodiment of non-lethal vehicle immobilization device that will entangle front or rear tires of a target vehicle.
Figure 24B:
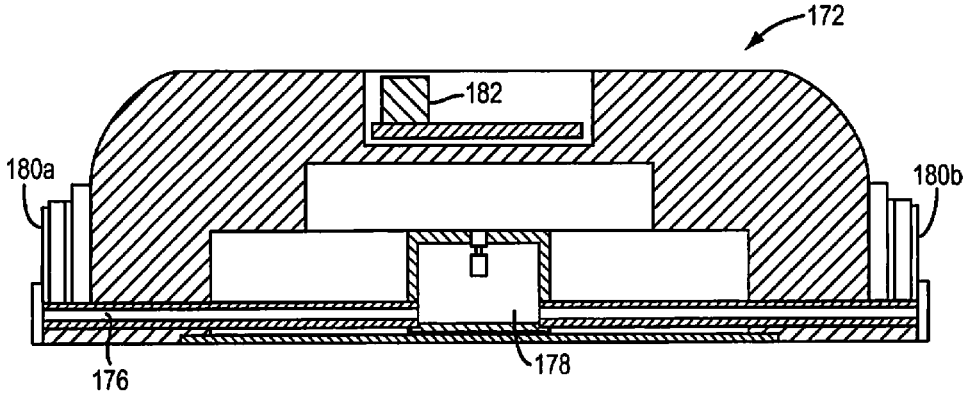
FIG. 24*b* is a pictorial and simplified cross sectional view of a propulsion device associated with the device of FIG. 24*a;*
Figure 24C:
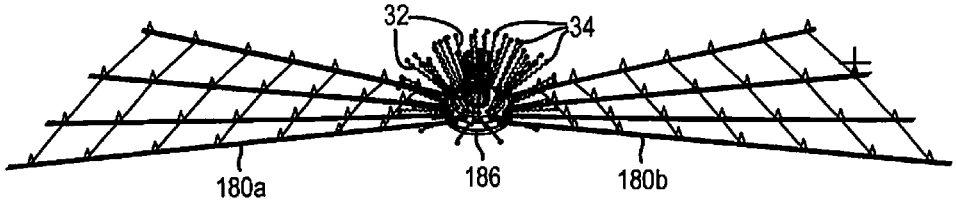
FIG. 24*c* is a further embodiment of non-lethal vehicle immobilization device shown in FIG. 24*a;*

Another embodiment of a non-lethal land vehicle restraint device is shown in FIGS. 24*a-c*. Both of the embodiments shown are similar to the restraint device described above with some design nuances that make both these embodiments suitable for temporary or permanent check point stations, border crossing access points, guard stations, and the like.

In the embodiment shown in FIGS. 24*a* and 24*b*, a housing body, very similar to that shown in FIG. 1 but without the projectile and tendril launch tubes, has a pressure delivery manifold 176 that may include a plurality of passages connected to a pressure generator chamber 178. In the embodiment shown in FIGS. 24*a* and 24*b* there will be eight passages as shown but more or fewer passages can be used as long as there is adequate pressure to launch the strap package, for instance the strap package shown generally as 180*a* and 180*b* in FIG. 24*a*.

A signal receiver 182 is provided to receive a transmitted signal from a control point for the device. For instance, in a check point situation, personnel manning the checkpoint will be able to send a signal, usually a radio signal. Other signal transmission options are contemplated by the inventor, including but not limited to, a hard wired circuit, an infrared signal or a microwave signal. Upon activation by an operator, the pressure generating chamber 178 will be activated and pressure sufficient to launch the strap packages 180*a* and 180*b*. In one embodiment the straps will include an inflatable bladder inside a tubular shaped strap which when inflated will send the straps outward from the housing 174. In one embodiment of the invention a proximity sensor can be used to activate the device after an operator has activated the devices. When the strap packages are deployed, a grid of straps, including upwardly extending spikes such as 184, will spread across a control zone. This may be, for example, a portion of a roadway. Any vehicle that attempts to drive over the deployed strap package will become entangled in the straps of the strap package. Entanglement of the vehicle will cause the vehicle to be stopped by the straps entangling the tires of the vehicle. In this embodiment there were no projectile and tendril launch tubes or components used, however the spikes of the strap package in contact with the tires of a vehicle will engage the strap package with the tires of the vehicle.

The embodiment shown in FIG. 24*c* is similar to FIG. 24*a* with regard to the strap packages 180*a* and 180*b*. In this embodiment the body of the housing 186 will have strap package inflation ports necessary to inflate and deploy the number of straps in the packages. In this case there will be four strap inflation ports on each side of the housing 186, similar to the FIG. 24*a* embodiment. This FIG. 24*c* embodiment includes the ability to launch projectiles and tethers, similar to the device of FIG. 1. The launch of the projectiles will be as for the launch of the projectiles as set forth in FIG. 1.

Figure 25A:
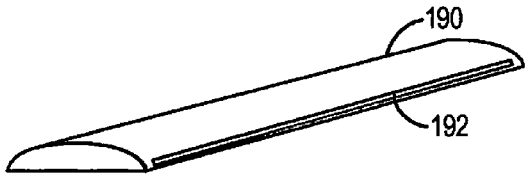
FIGS. 25*a* through 25*c* show a pictorial representation of an undercarriage immobilization device in a speed bump configuration from a static undeployed state to a state partway through activation.
Figure 25B:
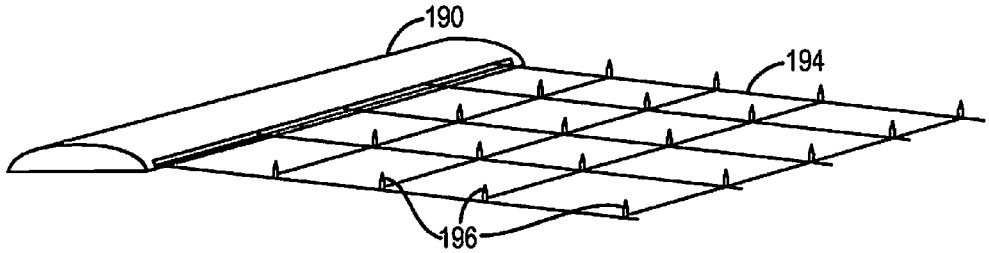
Figure 25C:
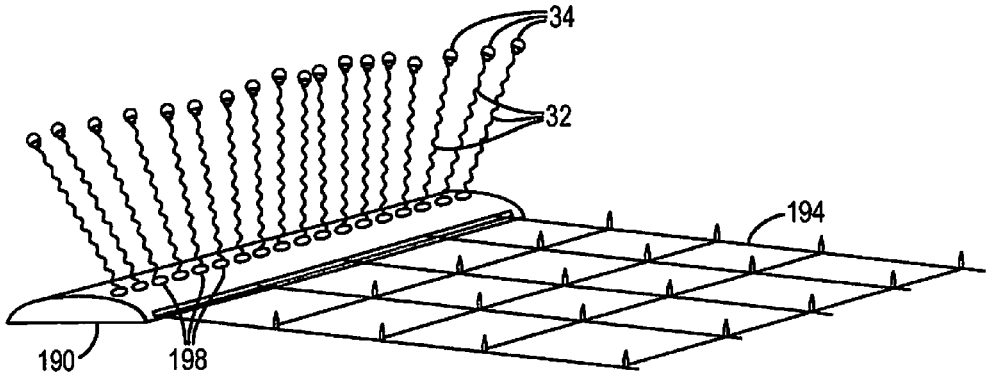

FIGS. 25*a-c* show another embodiment of a non-lethal vehicle restraint device. This is an active speed bump configuration. In FIG. 25*a* a container or housing 190, being a long, low housing, has an access port 192. The housing 190 will be placed on a roadway, normally perpendicular to the flow of traffic, although it could be located at the side of a road or any other position on a traffic surface, as long as when it is activated the strap package 194 will be positioned in the path of expected traffic and in particular, a target vehicle.

FIG. 25*b* shows the strap package 194 in position to engage with a target vehicle. The straps are equipped with spikes such as 196 that will penetrate and stick to a tire of a target vehicle. The strap package can be deployed from the housing 190 using a strap inflation system including a pressure generator connected to a manifold. When the device is activated, either by a remote actuator signaling by an operator controlled switch, or by a proximity detector, the straps of the strap package 194 will be deployed as is taught by the FIG. 1 device herein. Alternatively, in another embodiment, the strap package can be pulled manually from the housing 190

FIG. 25*c* is a linear embodiment of the normally round housing as is discussed above. This speed bump configuration includes the elements of FIG. 25*b* and also includes a projectile and tendril launch option as shown. This linear array of launch tubes, such as the launch tubes 198, are similar to the launch tubes shown in FIG. 1. The projectiles 34 will be launched either remotely by a operator or automatically by a proximity switch (not shown) mounted to or on the housing 190. Upon activation of the launch control to launch the projectiles, a launch is shown in mid-deployment, the projectiles will be launched and the projectiles will entrain themselves to the target vehicle. The tendrils 32 may be of very high strength materials so as to restrain the vehicle in the event that the strap package 194 is not fully engaged with the vehicle.

Figure 26:
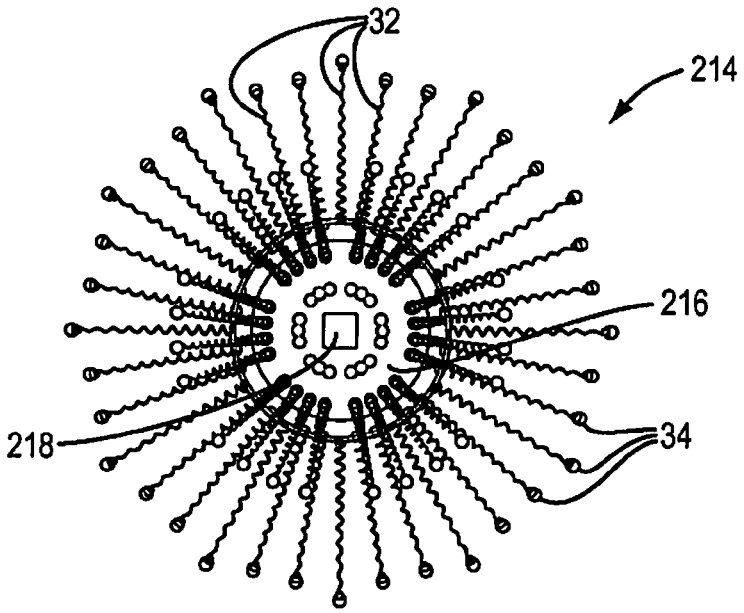
FIG. 26 is a non-lethal immobilization device as packaged for delivery as a bola device, flying disc or puck, shown in a partially deployed state.
Figure 27:
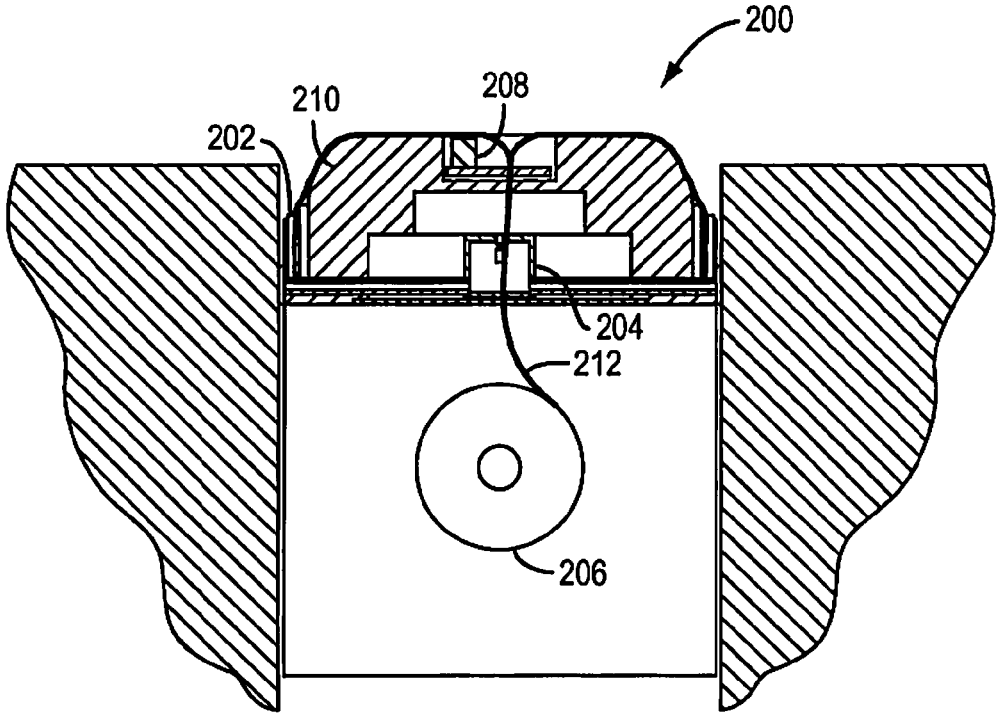
FIG. 27 is an embodiment of an immobilization device incorporating an inertia device shown in cross section view with the device positioned for deployment in a cavity of a road surface.

FIG. 27 is another embodiment of a vehicle restraint device that is useful in more permanent check point stations, border crossing access points, guard stations, and the like. This embodiment, shown as a non-lethal restraint device generally 200, is similar to the FIG. 24*b* version of the propulsion device in that, in one embodiment, the embodiment shown, it does not include the projectile and tendril launch tubes. This device does include an inertia reel 206 not shown in any of the embodiments discussed earlier. The device of FIG. 26 also includes a system, similar to FIG. 24*b*, that will launch a strap package 202 when the device is triggered, either remotely or through a proximity sensor, or the like. Upon activation and triggering, by sending a signal to the signal receiver and associated triggering circuitry 208, high pressure gas generated in the gas generator will launch the strap package 202. This strap package 202 will be launched and either spread out on the road surface in anticipation of a vehicle approaching it or it will be launched when a vehicle is proximate or over the non-lethal restraint device housing 210. The strap package will incorporate an inflation capability heretofore described that launches the straps upwardly and then outwardly to lie on the ground. The straps may include spikes or other adhesive elements that will, when in contact with a vehicle, either through the spikes penetrating the vehicles tires or the straps sticking to the vehicle, become engaged with the vehicle. Stopping of the vehicle will be accomplished by, not only entangling the vehicle undercarriage moving components with the straps as described above, but will also provide for restrained tension to be transferred through the strap package. This is accomplished using the inertia reel 206 or other similar energy absorbing device. A leader, line, cable, or strap 212 is attached to the strap package at one end. A section of the leader, line, cable or strap 212 is then connected to and wound on the reel 206. The inertial reel 206 will provide resistance to the unreeling of the leader, line, cable, or strap to slow down the playing out of the strap package after it is connected to the target vehicle. This will assist in avoiding strap separation as well as provide a less violent restraint of the now engaged target vehicle. The inertia reel 206 can be any type of inertia inducing or controlling device, such as, but not limited to, a clutch system, an inertia brake system, a fluid dampening system, an electrical field and armature arrangement, or the like.

Aquatic Vehicle Restraint

Another embodiment of a vehicle restraint device, one that is also non-lethal, is the aquatic mine device that can be pre-placed either partially submerged (covert) or visible (deterrent) above the surface of the water. The embodiment of the aquatic restraint device can slow, stop and disables waterborne vessels by fouling the propulsion system (propeller or jet-pump) by either stopping the system or rendering it hydrodynamically inefficient. The aquatic restraint device launches projectiles and tendrils at the precipice of ascension from a body of water. This occurs either when the device is floating partially above the surface of the water or when the delivery system submerged, from just below the surface of the water.

In one embodiment the aquatic mines are set up to communicate to the other mines forming a neural-net that senses target proximity to facilitate target location, ensnarement and to communicate the data to central command.

Another embodiment an aquatic mine device with a drogue or drag chute or a vessel entangler.

Figure 13:
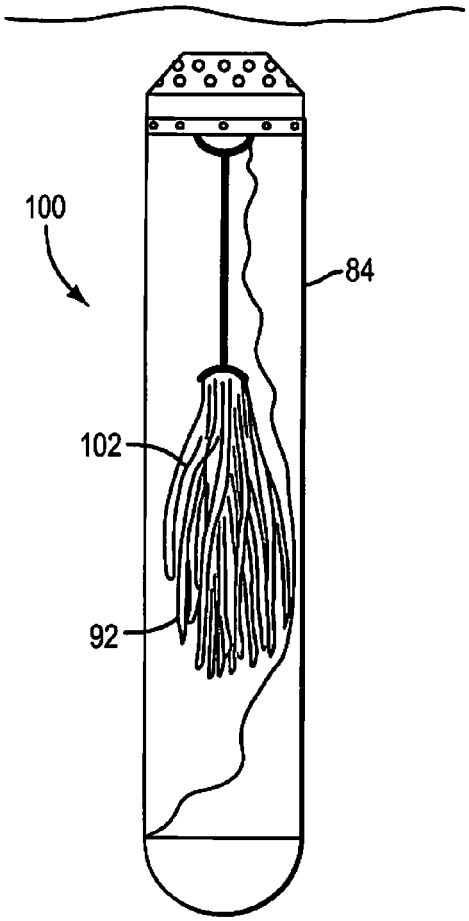
FIG. 13 is an underwater immobilization device, having a portion of the housing broken away, shown having entanglement straps or tendrils, the device floating partially below the surface of a body of water.
Figure 14:
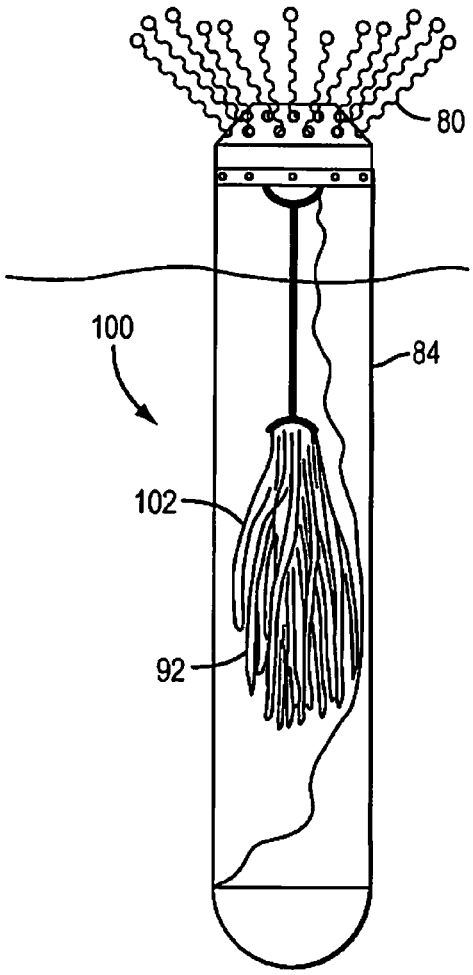
FIG. 14 is the device of FIG. 13 partially deployed with tendrils shown being launched from the device.
Figure 15:
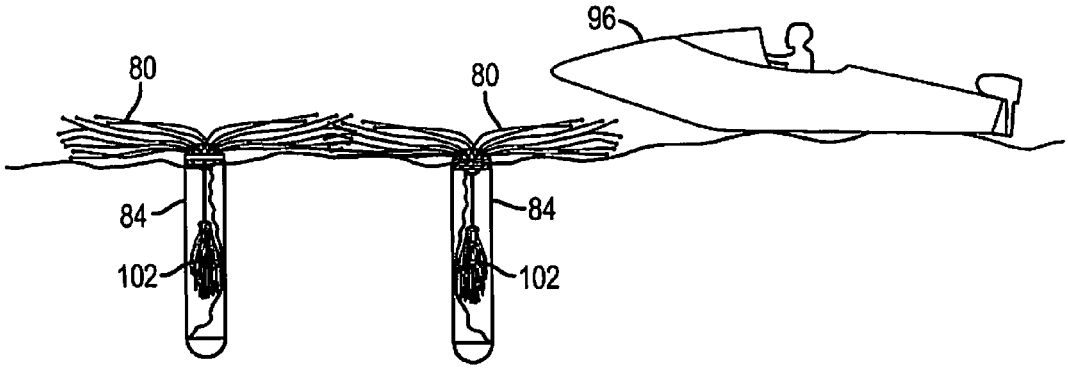
FIG. 15 is a pictorial representation of a set of devices shown in of FIG. 14 deployed in the path of an approaching target vehicle.
Figure 16:
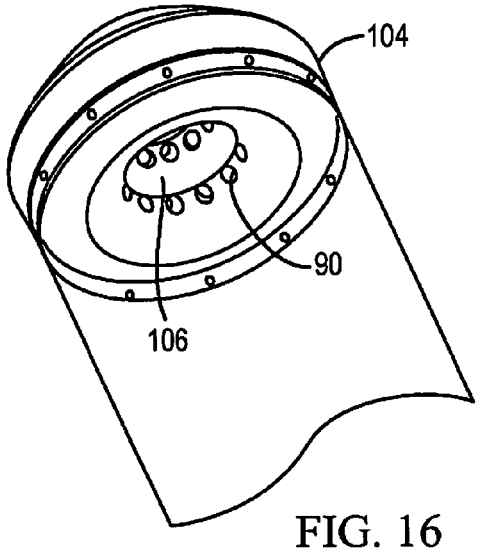
FIG. 16 is a projected view of the interior of an underwater immobilization device, having a portion of the body removed, showing the passage for removal of a strap set as used in the device of FIG. 13.

The basic principle of the land vehicle restraint device is incorporated into the aquatic vessel restraint devices. One embodiment is shown in FIGS. 9-12 and a second embodiment is shown in FIGS. 13-15.

Turning first to figures pertaining to a drag chute embodiment shown in FIGS. 9-12. The device generally 80 includes a tendril deployment head 82, a cylindrical body 84, partially broken away to show the drag chute inside the cylindrical body, and a ballast weight 86. A drag chute 90, connected to the head 82 or in one embodiment body 84, is housed in the cylindrical body 84 until the drag chute is deployed.

In operation the aquatic restraint device can be loaded with ballast to set the buoyancy of the mine. As the ballast weight is adjusted, the depth that the aquatic restraint device floats partially above the surface of the water or below the surface of the water can be set or regulated.

Figure 9:
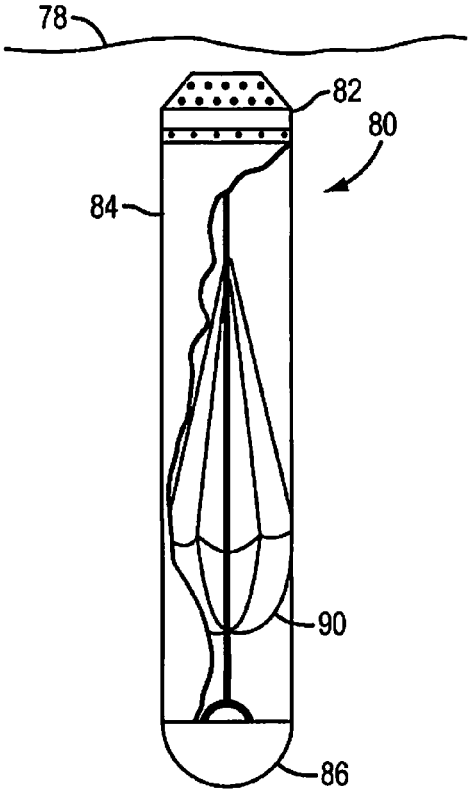
FIG. 9 is an underwater immobilization device, having a portion of the housing broken away, shown floating below the surface of a body of water.
Figure 10:
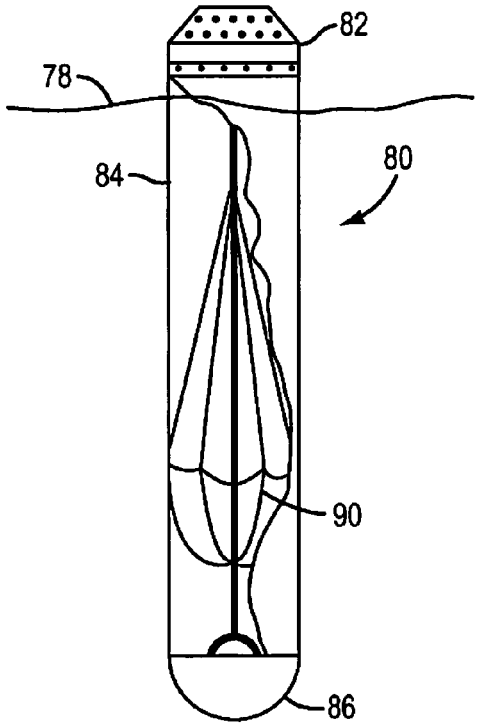
FIG. 10 is an underwater immobilization device, having a portion of the housing broken away, shown floating partially above the surface of a body of water.

FIG. 9 shows an aquatic vehicle restraint 80 that is floating just below the surface 78 of the body of water. FIG. 10 shows the aquatic restraint device 80 in a deployment attitude where it floats only partially submerged with the tendril deployment head 82 above the surface 78 of the water. One reason for the aquatic restraint device to be deployed above the surface of the water is to discourage vessels from entering a controlled zone by allowing a vessel operator to see the top, or tendril deployment head, of the device. Another reason for having the top of the device above the surface of the water is to enhance on board sensor acuity or allow visual contact between the device, using a proximity detector or a camera based surveillance device, and a target vessel; or the aquatic restraint device and an observer monitoring the device and its surroundings.

Figure 11:
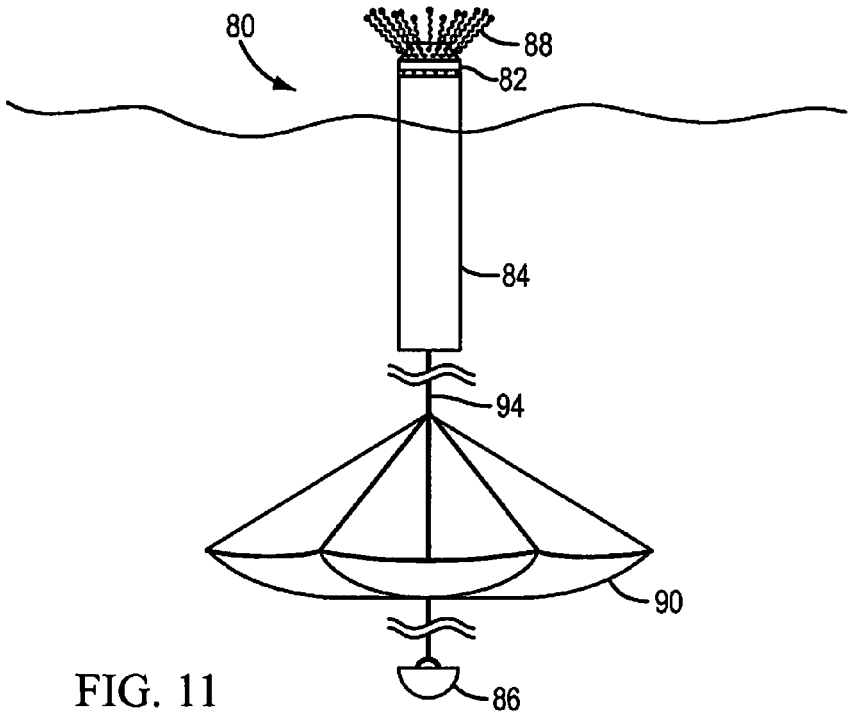
FIG. 11 is an underwater immobilization device shown partially deployed and floating partially above the surface of a body of water.
Figure 12:
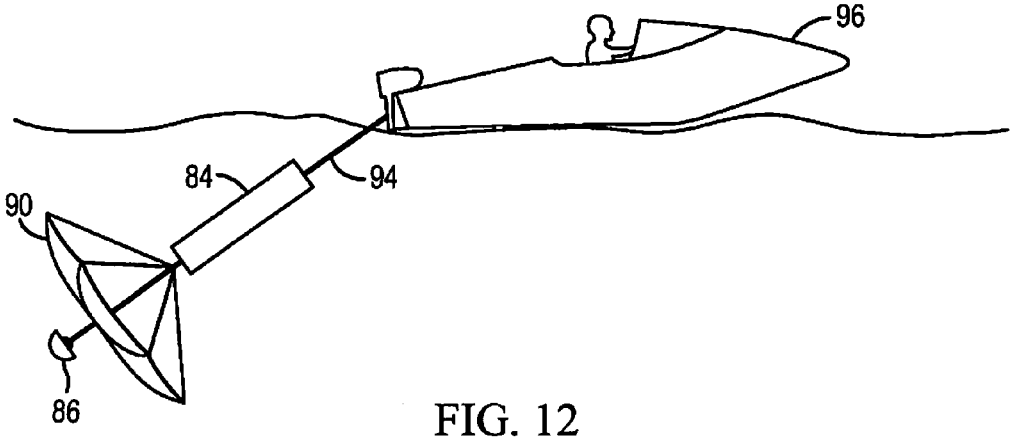
FIG. 12 is a pictorial representation of the device of FIG. 11 being dragged by a target vehicle.

FIG. 11 shows the aquatic restraint device, generally 80, in an activated state just before entangling a propeller of a prop driven vessel. Sensors, in one embodiment, a passive sonar device (not shown), on the aquatic restraint, will sense a vessel approaching the device. Other sensors, such as but not limited to, proximity sensor or other methods, may be used as an alternative to the passive sonar device to trigger activation of the device. Upon sensing an approaching vessel the tendril deployment head 82 will launch tendrils, such as tendrils 88, shown in mid-deployment in FIG. 11. These tendrils will float on the surface of the water and spread out around the device.

A vessel 96 passing over the zone where the floating tendrils are spread out on the surface of the water will run afoul of the tendrils and the tendrils will entangle the propeller of the vessel. The tendrils are attached to the tendril deployment head 82 that is attached to the cylindrical body 84. The cylindrical body 84 is attached to a strap 94 connecting the drag chute 90 to the cylindrical body 84. The drag chute 90 will be dragged behind the vessel once the device is entangled with the propeller, assuming that the vessel has not been stopped by the tendrils fouling the propeller, or other projection on the underside of the vessel. The drag chute 90, connected through a long strap 94 attached to the device housing 84, dragging through the water, will slow the vessel 96 while the ballast 86, also attached by a strap to the drag chute, will keep the drag chute 90 under water for proper drag attitude.

In a situation where a mine is floating just below the water surface it may be desirable to raise the device above the surface of the water just before the tentacles are deployed. This can be done by having the device 80 pop out of the water by releasing the ballast 86 from the housing 84 while a long strap 94 still attaches the ballast 86 to the structure of the device. The cylindrical body 84 will contain some air, so when the ballast is released, the cylindrical body, buoyed by the contained air, will be forced up by buoyancy. By sensing or timing when the head of the device is above the surface of the water, the head will launch the tendrils. In one embodiment this launching will occur at the precipice of the cylindrical body's assent.

FIGS. 13 through 16 illustrate another embodiment of an aquatic restraint device, in this case, a propeller entangler generally 100. This is similar to the device described above but does not include the drag chute involved in the previous embodiment. In this embodiment a modified tendril deployment head, shown in FIG. 16, includes a center port 106 through which an entangler 102, not shown in FIG. 16, will be pulled. A series of apertures 90 are formed in the modified head 104. These apertures 90 allow for access to the bottom of the chambers that hold the projectiles, the spools with the coiled tendrils, and the propulsion chamber associated with launching the projectiles. Access through these apertures may be used in reloading the chambers after the projectiles have been launched.

Alternatively, a net (not shown) may be carried in the cylindrical body 84. The net can be pulled through the center port 106 of the head 104 similar to the way the entangler is pulled through the center port 106 of the head 104. In another embodiment the inventors contemplate using an airbag type device to foul or render a large prop hydrodynamically inefficient. This may be effective in stopping very large boats or ships.

Turning to FIGS. 13-15, it is shown that the tendrils 80 will be attached to the projectiles 34 at one end of the tendril and will be attached to the entangler 102 at the other end of the tendril. The tendrils will extend from the projectiles through the center port 106 of the head 104, going in over the top of the housing of the head, through the center port 106 and then to the entangler 102. Thus when the tendrils are pulled from the head 104 they will pull the entangler through the center port 106 leaving the entangler head 104 and the attached cylindrical body portion 84 behind.

FIG. 13 shows a propeller entangler generally 100 partially submerged, representing one deployment option, while FIG. 14 shows a fully submerged propeller entangler also shown as 100. Like the drag chute embodiments shown in FIGS. 9 and 10, the subsurface or partially exposed deployment are options that may be selected based on a determination of the need to have the device submerged or not.

In operation the vessel immobilization device or aquatic restraint device 100 will sense the presence of a vessel 96 and launch a collection of tendrils 80 that will surround the aquatic restraint device 100. As the vessel 96 is driven over the tendrils 80, the tendrils 80 will be entangled in the propeller of the vessel or ingested into a jet pump drive of the vessel. The entangled tendrils will pull the entangler 102, a group of straps, tendrils, ropes, or cables 92, collected in a bundle making up the entangler 102. The straps 92 may be similar to the secondary straps discussed above. The straps of the entangler 102 will be drawn into the propeller or into the jet pump of the vessel 96 and or render the jet pump or propeller hydrodynamically inefficient and slow and eventually disable the jet pump or propeller thus slowing and stopping the vessel 96. By pulling the entangler 102, or a net as another option or embodiment, through the center port 106 of the modified head 104 of the vessel restraining device, the modified head 104 can be recovered for reloading and reuse as it will not be dragged by the vessel attached to the entangling straps.

Perimeter Defense System

A plurality of embodiments based on the basic vehicle restraint device shown in FIG. 1 are presented in FIGS. 17-19 and 20*a* and 20*b*. These devices are useful as perimeter defense devices that can be used to help protect the perimeter of a geographic zone. These perimeter defensive devices may be activated using an infrared detection device, a proximity sensor, a trip wire triggering device, or a manual for remote trigger.

One embodiment of a perimeter defense device is similar in structure to the well-known Claymore mine in that it can be located on the ground to face outwardly from the zone to be protected. This device is shown in FIGS. 17-19.

Figure 17:
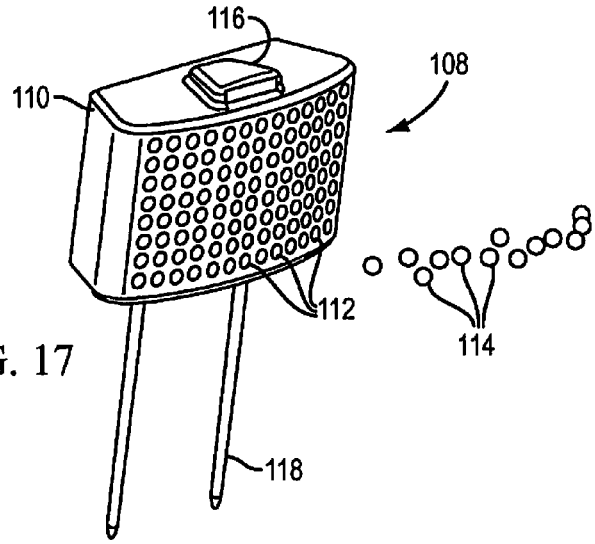
FIG. 17 is a perimeter defense device capable of launching projectiles.

FIG. 17, the device generally 108, includes a housing 110 having a plurality of apertures or barrels such as 112. These apertures 112 will house projectiles such as 24 as shown in FIGS. 7 and 8, with or without the tendrils. Spikes 118 may be provided to secure the device in the ground. In the FIG. 17 embodiment no tendrils are attached to the projectiles. In this embodiment the compressed air or gas generator launched projectiles may be metal projectiles, plastic, rubber or rubber-like projectiles or may be frangible balls such as paint balls other types of projectiles capable of encasing or being coated with adhesives, noxious or chemical agents. The frangible balls, such as 114 may be filled with a die or marking solution and when launched will hit a target and leave a traceable marker on any target that has been hit by a frangible ball. For instance, an alternative to the paint ball would be a substance such as a fluorescent material that will be visible using a low light night vision device. Another alternative substance may be an adhesive that will cause items such as the tendrils to stick to the targeted individual.

The FIG. 17 embodiment is shown with an optional sensing device 116. The sensing device may be a proximity detector, such as, but not limited to a motion sensor, an infrared sensor, for instance, or may be a receiver to receive a radio signal from a remote triggering location.

Figure 18:
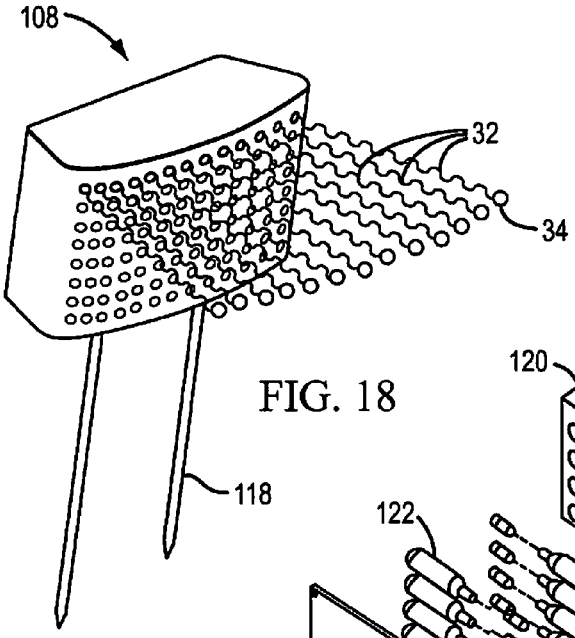
FIG. 18 is an embodiment of a perimeter defense device capable of launching projectiles having tendrils attached to the projectiles.
Figure 19:
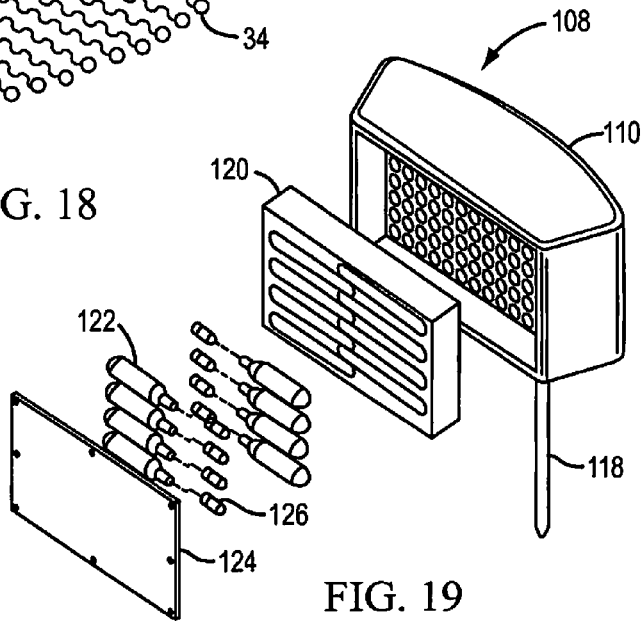
FIG. 19 is an expanded view of the device shown in FIG. 18.

FIG. 18 is an embodiment of the device shown in FIG. 17. This embodiment uses the launch devices, such as the projectiles 34 and spool of leader tendril, shown in either FIG. 7 or 8. The projectiles are launched the projectiles may be metal, plastic or rubber or rubber like masses, or they may be frangible projectiles. The frangible balls may contain an adhesive, a marker, or hooks, barbs, or other attachment elements, as is the case with the FIG. 17 embodiment. When the projectiles are launched they are intended to entangle a target and restrain the target to slow down the progress of the target.

FIG. 19 is an expanded view of the devices of FIGS. 17 and 18. In this view the device 108 has a back panel 124 that, when removed, provides access to a magazine 120 and the contents there in. A plurality of $CO_2$ cartridges, such as 122, or other pressure storage devices, are carried in the magazine 120. The cartridges 122 will be connected to a pressure release device 126 that will, when activated to launch the projectiles, release the gas or pressure stored in the cartridges 122. The cartridges are used as the propellant to launch a volley of projectiles, not necessarily all of the available projectiles at one time, from the front of the device. In one embodiment, after a programmed delay, a sensor carried in the perimeter defense device, resets to avoid multiple volleys in a short time frame. These devices could be recovered, reloaded with a set of fresh projectiles and $CO_2$ cartridges and redeployed. In an alternative embodiment the cartridges can be replaced with a gas generator mechanism like the other devices described heretofore.

Figure 20A:
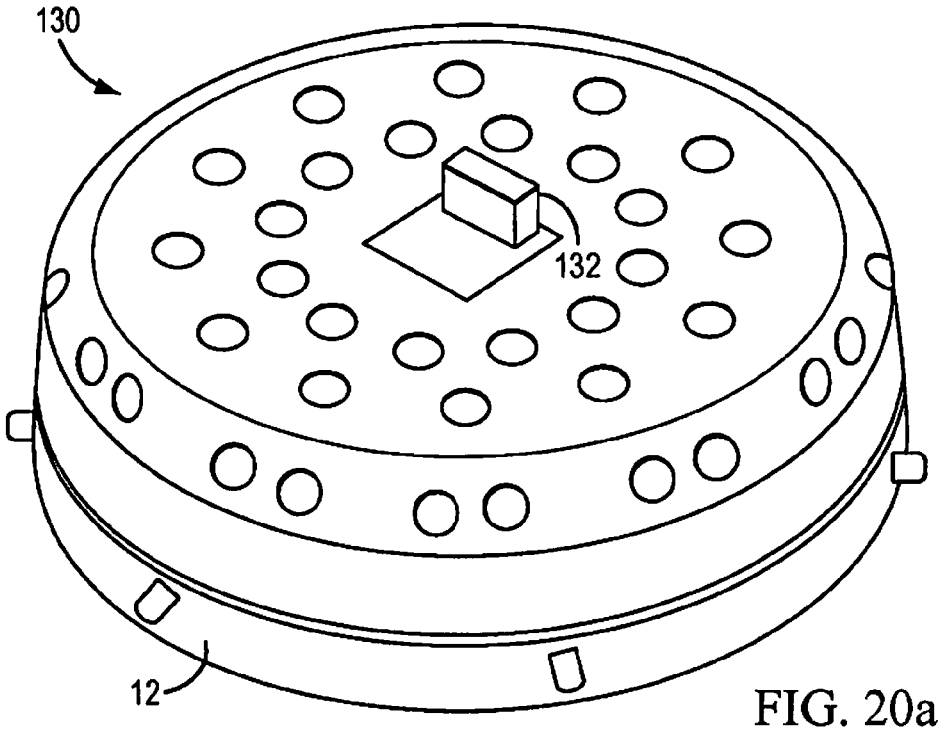
FIGS. 20*a* and 20*b* depict a static land mine configuration immobilization device of a type used for perimeter defense and the same land mine in mid-deployment.
Figure 20B:
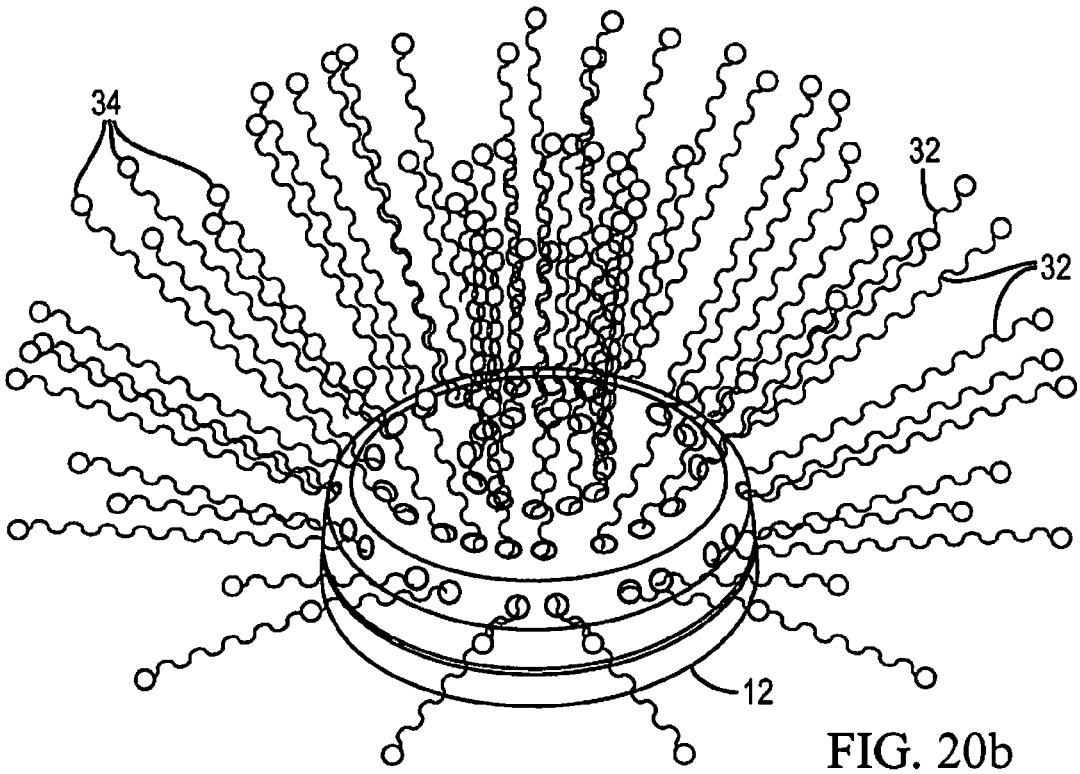

Another embodiment useful as a perimeter defense device is shown in FIGS. 20*a* and 20*b*, is a land mine device, generally 130. This device is similar to the FIG. 1 device but is modified to be activated by a contact or pressure switch 132. Alternatively the device can be triggered by a proximity switch, a trip wire, an infrared detector or by radio signal from an observer or another land mine. In this embodiment only projectiles 34 and tendrils 32, FIG. 20*b*, are carried in the housing 12. They will be launched by the same projecting launch systems used in FIG. 1 however, the embodiment of FIGS. 20*a* and 20*b* will not include the primary or secondary strap packages shown in FIG. 1, et seq.

Personnel Ensnarement Restraint and Stand-Off Crowd Control System

Another embodiment of a non-lethal restraint device is a launched projectile that will spread a net over a person, crowd, or animal. The launched projectile embodiment is also similar to the vehicle restraint system that is disclosed above in that a filament and net structure is launched to ensnare targeted individuals. The ensnarement restraint device is a device that is launched from a launcher such as, but not limited, to a shoulder launched multi-purpose assault weapon, a mortar launcher or as an M203 launched round.

These embodiments are shown in FIGS. 21*a-c*, FIGS. 22*a-b* and FIGS. 23*a-c*.

Figure 23A:
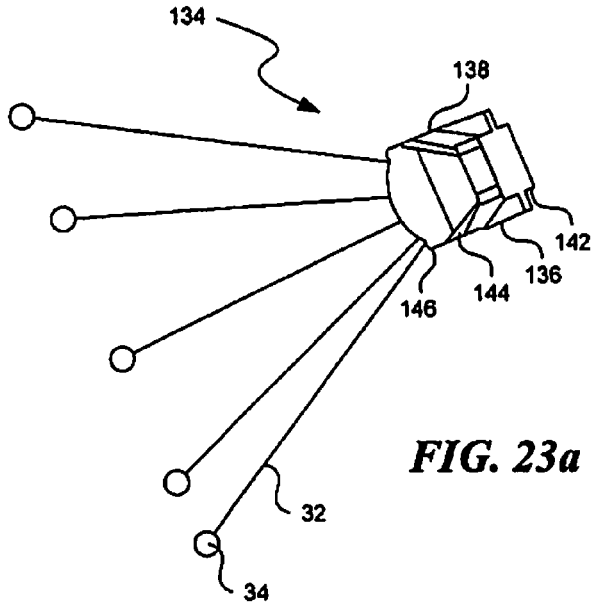
FIG. 23*a* is a pictorial representation of a partially deployed launched device in mid-deployment of a net delivery system.
Figure 23B:
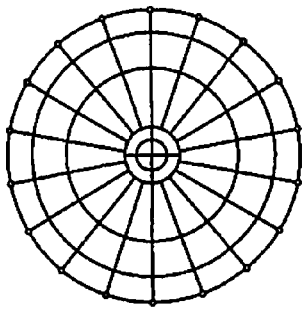
FIG. 23*b* is an embodiment of a net used in one embodiment of the invention.
Figure 23C:
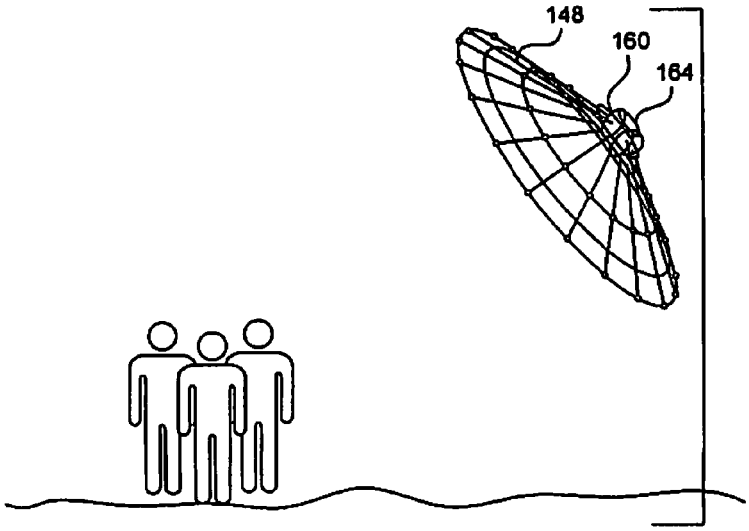
FIG. 23*c* is a pictorial representation of a net deployed by the devices of the invention about to descend on a target group.

FIGS. 23*a-c* show a personnel immobilization directed ensnarement restraint device. In FIG. 23*a* the launched device generally 134, has a plurality of ports 138 circumferentially arranged around the body 140 of the device 134. These ports 138 will contain a projectile and tendril charge similar to the devices in FIGS. 7 and 8. In FIG. 23*a*, which is a sectioned view to show the interior and its contents in a clarifying presentation, there will be a gas generator section 142, a flow path guide 144, and a net storage section 146 for storing a net. The net may approximate the net configuration shown in FIG. 23*b* or be a net having a different shape, different void area spacing, and will have, in one embodiment, projectiles and tendrils extending beyond the circumferential perimeter of the net. That is, the net as launched from the configuration shown in FIG. 23*a* shows tendrils leading any section of net having transverse lines between the tendrils. In FIG. 23*a* the device is shown in a mid-activation state. A plurality of projectiles 34, attached to tendrils 32, have left the ports 138 of the device 134 pulling the tendrils with them. These tendrils 32 are attached to a net stored in the net storage area. As the tendrils are propelled outwardly they will drag the net from the net chamber. The net will also be propelled out of the net chamber using pressurized gas generated in the gas generator 142. This gas generator supplies gas to launch both the projectiles with the tendrils as well as the net 148.

FIG. 23*c* is presented to show how the net can be launched in the direction of a target, in the illustration, a group of people. The net 148 will quickly ensnare the people as can be imagined from looking at FIG. 23*c*. It should be noted that the net illustrated in FIG. 23*c* is a net that can be launched from a shoulder launched assault weapon or from a mortar as is described below.

Figure 21A:
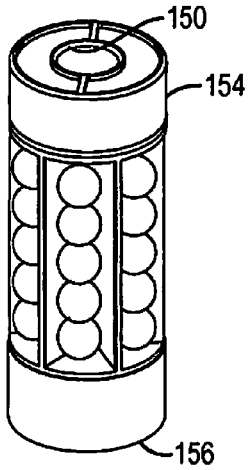
FIG. 21*a* is a launchable round containing projectiles and a net.
Figure 21B:
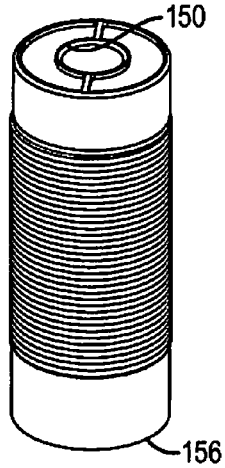
FIG. 21*b* is a launchable round containing projectiles and a net and including an outer surface wrap.
Figure 21C:
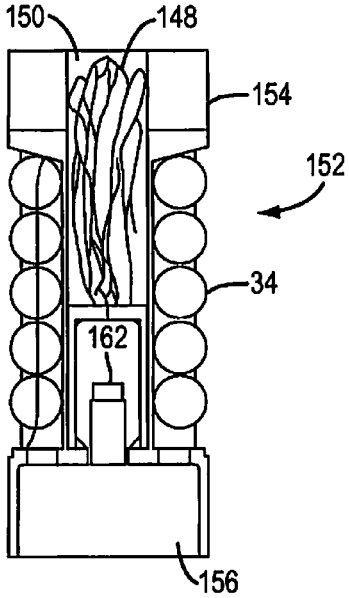
FIG. 21*c* is a cross sectional representation of the launchable round set forth in FIG. 21*a;*
Figure 22B:
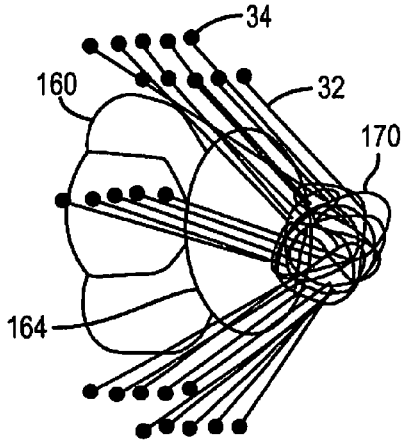
FIG. 22*b* is a partially deployed round as set forth in FIG. 21*a* further through its deployment.

FIGS. 21*a-c* are illustrations related to a net, such as net 148 in FIG. 23*b*, that is intended to be launched from a grenade launcher. In this embodiment the net 148 is stored in a cavity 150 of the net delivery projectile generally 152. This device 152 includes a proximity sensor 154. The proximity sensor will detect the proximity of a target and will cause a gas generator 156 to launch the projectiles 34. The gas generated in the gas chamber 156 will also generate pressure to inflate a center airbag 160 supported in a sabot 162 until the airbag is inflated to dispose the sabot 162.

Figure 22A:
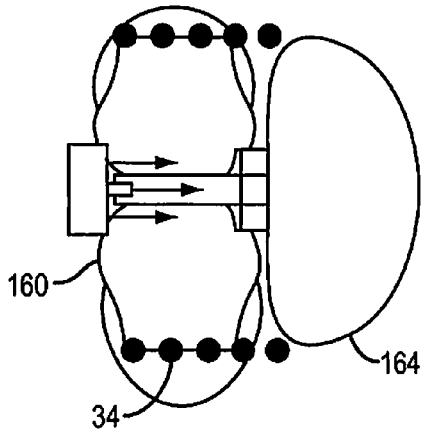
FIG. 22*a* is a partially deployed round as set forth in FIGS. 21*a* and 21*c;*

FIGS. 22*a* and *b* show two phases of the activation, partially complete, of the device in FIG. 21*c* being actuated. In FIG. 22*a* the central airbag 160 has been at least partially inflated by gas generated from the gas generator. The projectiles 34 are still moving outward from the body of the net delivery projectile while the whole unit travels toward a target. The sabot has been dispersed at this point and the airbags are free to inflate. A second air bag 164 is also being inflated at the same time. This air bag 164 is will assist in the launch of the net 148, shown as part of the mass of fibers 170, shown in FIG. 23*c* closing in a target group. In this figure the inflated air bags can be seen as items as 160 and 164.

Another embodiment of the invention is shown in FIG. 26. This is a top view of a flying disc or saucer device 214. In this embodiment the flying disc device 214 is intended to be launched by a launcher, such as, but not limited to, a launcher of the type used to launch clay pigeons, or by being flung and throw by a person. The flying disc 214 will include a housing 216 that includes launch tubes for storing and eventual launching of projectiles, such as mass elements, plastic, or rubber elements, or frangible balls. These projectiles, such as projectiles 34 will be attached to tendrils such as 32 as have been described earlier in this specification. The primary operation mode of this embodiment is as a bolo style entangling device.

However, in an alternative embodiment, a proximity sensor may be carried in cavity 218. Alternatively, an accelerometer can be carried in the cavity, or in another location of the flying disc, such as, but not limited to a control circuit board, carried in the device similar to the circuit board used in the FIG. 1 device. In operation this flying disc 214 will be thrown or launched toward a target, such as an individual, an animal or a vehicle. When the flying disc gets close to the target the projectiles and tendrils will be launched. In the embodiment where an accelerometer is used the flying disc can actually contact the target and the accelerometer will initiate the firing of the projectiles and tendrils having the effect of tangling the target, in this situation the device does not have the attributes of a bolo device.

In the bolo-like embodiment this device will perform as a bolo device, a device with a mass at both ends of a line that is throw at a target and wraps around the target on contact. In this case the tendrils, with the weights in the form of the projectiles at the ends of the tendrils, will contact the target and wrap around the target like a bolo device. The masses at the ends of the tendrils will keep wrapping the tendrils by centripetal force on the tendril until the length of the tendril is wrapped around the target. The projectiles may stick to, if they are frangible balls filled with an adhesive, to entangle, deter, or mark the target with a tracking substance, for instance, the target. This will cause the target to become entangled with the tendrils thus affecting the movement capability of the target or marked with identification fluid. It may or may not use a proximity detector to release the projectiles and tendrils.

Another embodiment utilizing the bolo device principle is to have a remote controlled aircraft as a delivery platform for the bolo device. In this embodiment the bolo device will be launched from the platform after it is "spun up" to extend the projectiles and tendrils. It will then be in motion as a bolo like device ready to entangle the target when contact is made between the bolo device and the target.

In one further embodiment of the invention an entanglement device is provided for use as a riot control tool. An entanglement device or other crowd control devices, such as capsaicin-filled balls or projectiles containing or coated with other noxious chemical agents or adhesives is mounted on a shield, post, or vehicle used in interacting with aggressors. A staged launch scenario is contemplated for increasing the severity of the device effects, i.e. "escalation of force."

Figure 28:
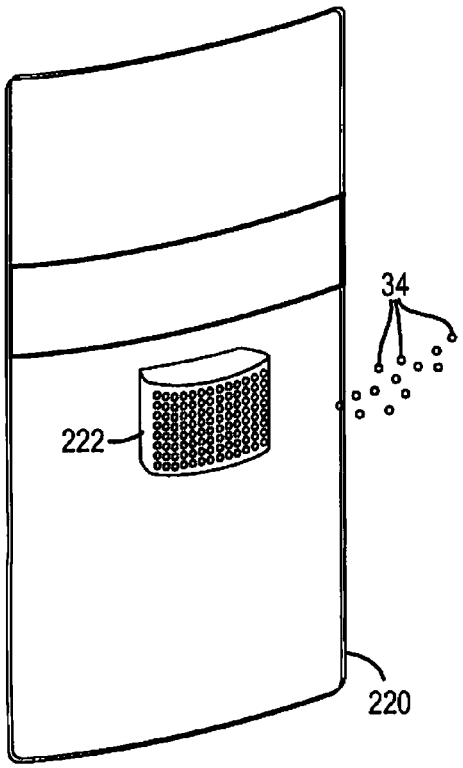
FIG. 28 is a perimeter defense device mounted to a riot shield shown deploying untethered projectiles.
Figure 29:
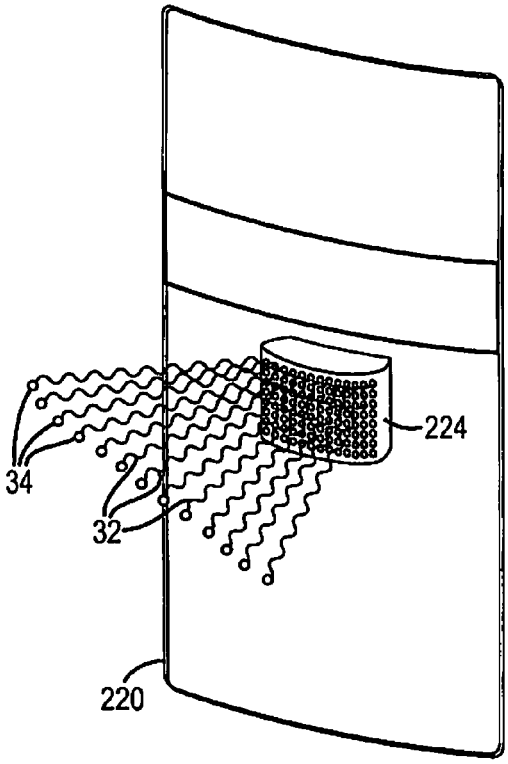
FIG. 29 is an embodiment of a perimeter defense device mounted to a riot shield shown midway through a launch of tethered projectiles.

FIGS. 28 and 29 show shields 220. In FIG. 28 a housing 222 is affixed to the front of the shield. This housing will contain a projectile launching system similar to the device shown in FIG. 17 which may include proximity sensor as shown in FIG. 17, but in one embodiment would use an operator controlled triggering device. In the FIG. 28 device the launch of projectiles such as 34 will be directed to a target and in contacting the target will mark the target, expose the target to noxious chemicals, or otherwise impair a target in a non-lethal way.

FIG. 29 is similar to the device shown in FIG. 28 but in this embodiment the projectiles 34 are attached to tendrils such as 32. In addition to being able to mark the target or expose the target to noxious chemicals the provision of the tendrils allow the tendrils to be wires to conduct an electrical charge. In this embodiment an electric shock weapon that uses electro muscular disruption, or neuromuscular incapacitation, technology can be deployed. The projectiles may include barbs for contact with a target. As an alternative a shaped pulse, which does not require a barb to penetrate the skin of the target, may be used.

The projectiles may be filled with a chemical irritant, adhesive, marker or tracking device. Projectiles may rupture upon contacting the subject target or may break as the target or subject struggles to escape break thus releasing the contents of the projectile.

While the invention is described herein in terms of preferred embodiments and generally associated methods, the inventor contemplates that alterations and permutations of the preferred embodiments and methods will become apparent to those skilled in the art upon a reading of the specification and a study of the drawings.

Accordingly, neither the above description of preferred exemplary embodiments nor the abstract defines or constrains the invention. Rather, the issued claims variously define the invention. Each variation of the invention is limited only by the recited limitations of its respective claim, and equivalents thereof, without limitation by other terms not present in the claim.

What is claimed is:

1. Apparatus for ensnarement of a vehicle having a wheel and tire assembly and rotating components on the underside of the vehicle comprising:

a propulsion housing having a pressure manifold incorporated therewith;

a pressure generator carried in the propulsion housing;

an inflatable strap package in communication with the pressure manifold and the pressure generator, the inflatable strap package configured to ensnare the wheel and tire assembly;

an actuator for activating the pressure generator; and an inertial reel connected to the inflatable strap package.

2. The apparatus of claim 1 wherein the inertia reel is carried in the propulsion housing adjacent the inflatable strap package and the inflatable strap package is attached to the inertia reel with a cable.

3. The apparatus of claim 1 wherein the pressure generator comprises:

a first pressure generator in fluidic communication with a primary strap, and a second pressure generator in fluidic communication with a secondary strap.

4. The apparatus of claim 3 further comprising a proximity detector configured to:

detect a proximity of the vehicle to the apparatus, and provide a signal to initiate pressure generation by the second pressure generator.

5. The apparatus of claim 3 further comprising a plurality of projectiles each attached to a tendril, wherein the tendril is attached to at least one secondary strap.

6. The apparatus of claim 3 wherein at least one secondary strap package is launched from a spool prior in the propulsion housing.

7. The apparatus of claim 3 wherein at least one primary strap package comprises one or more barbs configured to puncture vehicle tires.

8. The apparatus of claim 1 further comprising a band configured to hold a secondary strap attached to the propulsion housing when a primary strap is deployed.

9. The apparatus of claim 1 further comprising a proximity detector configured to:

detect a proximity of the vehicle to the apparatus, and provide a signal to initiate pressure generation by the pressure generator.

10. The apparatus of claim 1 further comprising a plurality of secondary straps configured to ensnare the wheel and tire assembly.

11. The apparatus of claim 10 further comprising a plurality of projectiles each attached to a tendril, wherein the tendril is attached to at least one secondary strap.

12. The apparatus of claim 10 wherein the secondary straps are attached to primary straps and the secondary straps pull primary straps into an ensnaring engagement with the vehicle.

13. The apparatus of claim 1 wherein the inflatable strap package comprises one or more barbs configured to puncture vehicle tires.

14. Apparatus for ensnarement of a vehicle having a wheel and tire assembly and rotating components on the underside of the vehicle comprising:

a propulsion housing having a pressure manifold incorporated therewith;

a first pressure generator carried in the propulsion housing, the first pressure generator in fluidic communication with a primary strap;

a second pressure generator in the propulsion housing, the second pressure generator in fluidic communication with a secondary strap; and an actuator for activating at least one of the pressure generators, wherein the primary strap and the secondary strap are configured for entangling at least one of the wheel and tire assembly and rotating components on the underside of the vehicle.

15. The apparatus of claim 14 wherein the secondary straps are attached to the primary straps and the secondary straps pull the primary straps into an ensnaring engagement with the vehicle.

16. The apparatus of claim 14 further comprising a proximity detector configured to:

detect the proximity of the vehicle to the apparatus, and provide a signal to initiate pressure generation by the second pressure generator.

17. Apparatus for ensnarement of a vehicle having a wheel and tire assembly and rotating components on the underside of the vehicle comprising:

a propulsion housing having a pressure manifold incorporated therewith;

a pressure generator carried in the propulsion housing;

an inflatable strap package connected to the propulsion housing and in communication with the pressure manifold and the pressure generator, the inflatable strap package configured to ensnare the wheel and tire assembly;

a fracturable element capable of at least partially releasing the strap package from the propulsion housing;

an actuator for activating the pressure generator; and an inertia supplying device connected to the inflatable strap package an inertia supplying device connected to the inflatable strap package.

18. The apparatus of claim 17 wherein the pressure generator produces gas, and the fracturable element uses gas from the pressure generator to at least partially release the strap package from the propulsion housing.

* * * * *

UNITED STATES PATENT AND TRADEMARK OFFICE

CERTIFICATE OF CORRECTION

PATENT NO. : 8,757,039 B2
APPLICATION NO. : 12/901130
DATED : June 24, 2014
INVENTOR(S) : Martin A. Martinez It is certified that error appears in the above-identified patent and that said Letters Patent is hereby corrected as shown below:

In the Claims:

Column 23, claim 17, lines 27-28, after "package" delete "an inertia supplying device connected to the inflatable strap package"

Signed and Sealed this
Seventh Day of October, 2014

Michelle K. Lee

Michelle K. Lee
*Deputy Director of the United States Patent and Trademark Office*